US008093478B2

(12) United States Patent
Bailey

(10) Patent No.: US 8,093,478 B2
(45) Date of Patent: Jan. 10, 2012

(54) PERCUSSION INSTRUMENT AND ELECTRONIC PERCUSSION INSTRUMENT

(75) Inventor: Marianne Bailey, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 13 days.

(21) Appl. No.: 12/622,587

(22) Filed: Nov. 20, 2009

(65) Prior Publication Data

US 2011/0036230 A1 Feb. 17, 2011

Related U.S. Application Data

(62) Division of application No. 11/728,077, filed on Mar. 23, 2007, now Pat. No. 7,642,440.

(30) Foreign Application Priority Data

Mar. 23, 2006 (JP) ..... 2006-080816
Mar. 23, 2006 (JP) ..... 2006-080817
Mar. 23, 2006 (JP) ..... 2006-080818
Mar. 23, 2006 (JP) ..... 2006-080819

(51) Int. Cl.
*G10D 13/02* (2006.01)

(52) U.S. Cl. ..... 84/412

(58) Field of Classification Search ..... 84/412, 84/411 R, 419, 420, 411 P, 477 R
See application file for complete search history.

(56) References Cited

U.S. PATENT DOCUMENTS 3,113,480 A * 12/1963 Giarratano ..... 84/411 R
3,326,074 A 6/1967 Osty et al.
5,801,320 A 9/1998 Segan et al.
6,586,666 B2 7/2003 Abe
7,642,440 B2 1/2010 Bailey et al.

FOREIGN PATENT DOCUMENTS

| | | |
|---|---|---|
| CA | 2 529 308 | 6/2007 |
| JP | 63-006495 U | 1/1988 |
| JP | 07-199943 A | 8/1995 |
| JP | 07-225581 A | 8/1995 |
| JP | 10-293576 A | 11/1998 |
| JP | 2003-264884 A | 9/2003 |

OTHER PUBLICATIONS

Brochure for Drums Absolutely Handcrafted, Yamaha Corporation, created Oct. 2005, pp. 37-38.

Yamaha Drum Web Magazine (online), Silent Session Drum DTXPRESS III Special (searched Feb. 2, 2007 and Mar. 16, 2007), Internet URL: http://www.yamaha.co.jp/product/drum/column/co103103101/index.html.

* cited by examiner

*Primary Examiner* — Jianchun Qin
(74) *Attorney, Agent, or Firm* — Morrison & Foerster LLP

(57) ABSTRACT

A percussion instrument in which at least one drum board can be folded on a main board for easy and compact storage of the instrument. At least one arm having a free end and a proximal end is mounted at its proximal end to a part fixed relative to the main board so that the free end can be displaced in position. The drum board is mounted to the free end of the arm and changeable between an unfolded configuration suitable for a musical performance and a folded configuration suitable for storage by being configured to be unfoldable from and foldable to the main board via the arm.

20 Claims, 18 Drawing Sheets

PERCUSSION INSTRUMENT AND ELECTRONIC PERCUSSION INSTRUMENT

CROSS-REFERENCE TO RELATED APPLICATIONS

This application is a division of U.S. application Ser. No. 11/728,077, filed Mar. 23, 2007, issued as U.S. Pat. No. 7,642,440 on Jan. 5, 2010, the entire disclosure of which is incorporated herein by reference.

BACKGROUND OF THE INVENTION

1. Field of the Invention

The present invention relates to a percussion instrument having at least one drum board, and relates to an electronic percussion instrument.

2. Description of the Related Art

As described in the prior art documents 1 and 2 listed below, there has conventionally been known a percussion instrument (hereinafter referred to as the prior art percussion instrument or the prior art electronic percussion instrument) having drum boards such as pads and adapted for compact storage when it is not in use.

Prior art document 1: LM business department, planning and promotion office, GD administration division, brochure "DRUMS ABSOLUTELY HANDCRAFTED", Yamaha Corporation, created October 2005, pages 37-38

Prior art document 2: "YAMAHA DRUM WEB MAGAZINE (online)", Silent Session Drum DTXPRESSIII (searched Feb. 6, 2006), Internet <URL: http://www.yamaha.co.jp/product/drum/column/co103103101/index.html>

The prior art percussion instrument includes two rod-like support pillars thereof coupled through a coupling member to each other, drum board mounting members thereof attached to the support pillars and the coupling member, and drum boards thereof mounted to the drum board mounting members. Each of the drum board mounting members can be mounted, using screws, to a corresponding one of the support pillars and the coupling member in the desired position at the desired pivotal angle.

At the time of a musical performance, a positional adjustment of the drum boards is performed by operating the drum board mounting members with screws loosened/tightened to realize an unfolded configuration suitable for musical performance. On the other hand, at the time of storage of the percussion instrument, the screws at the drum board mounting members are loosened and the drum boards are displaced to the desired positions which are between the two support pillars, for example, and at which the drum boards are prevented from being bulky, whereupon the screws at the drum board mounting members are tightened.

However, with the prior art percussion instrument, a bass drum is difficult to be stored together with the other drum boards at the time of storage of the percussion instrument. In addition, a laborious operation must be made for the respective drum boards such as loosing the screws at the drum board mounting members, adjusting the position of the drum board, and tightening the screws.

In the course of storage of the percussion instrument, the positions and orientations of the respective drum boards are not fixed but are variable depending on the positions and pivotal angles of the drum board mounting members. In order to compactly fold all the drum boards, the respective drum boards must be folded into desired positions in an appropriate order.

For some drum boards such as a snare drum and a hi-hat cymbal which are closely arranged to each other, the order and positions in which and to which they are folded must be appropriately selected. Otherwise these drum boards sometimes interfere with one another, making it difficult to compactly fold them. However, it is difficult for a user to appropriately select the order and positions in which and to which the drum boards are folded, posing a problem that the entire percussion instrument cannot be compactly stored with ease.

Conventionally, an electronic percussion instrument generally comprises drum boards such as pads, which are percussion units, and is arranged to electrically produce a musical tone using a sound generation unit such as speakers when any drum board is struck. The aforesaid prior art electronic percussion instrument comprises a sound generation unit including an amplifier system and configured separately from a drum board set. During musical performance, the sound generation unit is disposed on the floor or the like near the drum board set.

However, the prior art electronic percussion instrument requires electric wiring that extends from the drum board set to the sound generation unit or to a circuit board in the sound generation unit. Thus, a laborious wiring operation is required. In addition, the visual quality of the percussion instrument is lowered since the electric wiring is seen from outside.

With the prior art electronic percussion instrument, the sound generation unit is disposed near the drum board set but is spaced away from the individual drum boards. Thus, the striking positions and musical tone generating positions are spaced far away from one another. As compared to an acoustic drum, there is an odd feeling with regard to sound generation positions, posing a problem of lack of reality.

In addition, the prior art percussion instrument requires the provision of extension members and narrow rod-like members that are used to set up the percussion instrument in a vertical configuration for musical performance and are dismounted at the time of storage of the percussion instrument, thus causing a problem of laborious vertical se-up and storage operations.

SUMMARY OF THE INVENTION

The present invention provides a percussion instrument in which drum boards are foldable to a main board for easy and compact storage.

The present invention provides a percussion instrument in which drum boards are folded so as to be closely stacked to each other for compact storage.

The present invention provides an electronic percussion instrument in which external wiring to a sound generation unit is made unnecessary to thereby simplify wiring connection, while ensuring that the sound generation unit is prevented from being struck.

The present invention provides an electronic percussion instrument in which wiring connection can be simplified.

The present invention provides an electronic percussion instrument in which a musical tone is made generated near from a beat position, to thereby increase a representational reality.

According to a first aspect of the present invention, there is provided a percussion instrument, comprising a main board, at least one support member having a free end and a proximal end, the support member being mounted at the proximal end to a part fixed relative to the main board such that the free end is displaceable in position, and at least one drum board each mounted to the free end of a corresponding one of the at least one support member, the drum board being changeable between an unfolded configuration suitable for a musical performance and a folded configuration suitable for storage by being configured to be unfoldable from and foldable to the main board via the support member.

With this arrangement, at least one drum board can be made folded to the main board, whereby easy and compact storage of the percussion instrument can be realized.

The drum board can be mounted to the free end of the support member so as to be variable in angle.

With this arrangement, the degree of freedom of the form of folding the drum board can be increased.

The drum board can be disposed closer to the main board when it is in the folded configuration than when it is in the unfolded configuration.

With this arrangement, the percussion instrument can be made compact at the time of storage as viewed in the thickness direction of the main board.

The drum board can be more parallel to the main board when it is in the folded configuration than when in the unfolded configuration.

With this arrangement, the percussion instrument can be made compact at the time of storage as viewed in the thickness direction of the main board.

A sum of minimum distances between the main board and all positions on the outer periphery of the drum board can be smaller when the drum board is in the folded configuration than when it is in the unfolded configuration.

With this arrangement, the percussion instrument can be made compact at the time of storage as viewed in the thickness direction of the main board.

A plurality of the drum boards can be provided, all the plurality of the drum boards can be disposed within the outer periphery of the main body as viewed from front of the main board when the plurality of the drum boards are in the folded configuration.

With this arrangement, the percussion instrument can be made compact at the time of storage in the direction in which the player-side surface of the main board extends (as viewed from front).

A plurality of the drum board can be provided, and a displacement stroke of each of the plurality of the drum boards between the unfolded configuration and the folded configuration can be arranged so as not to interfere with the displacement stroke of another drum board.

With this arrangement, even when the plurality of drum boards are unfolded/folded in an arbitrary order, each drum board can be appropriately displaced independently of the other drum boards without interfering therewith, making it possible to always appropriately fold/unfold the drum boards.

The main board can be formed into a plate-like shape.

With this arrangement, the main board can be simple in construction.

The main board can be formed into a net-like construction and can comprise at least one frame and a plurality of net members, each of the plurality of net members being connected at least to the at least one frame or at least one of the plurality of net members.

With this arrangement, the main board can be light in weight and an amount of material used for fabrication of the main board can be reduced.

The percussion instrument can further includes at least one cover member adapted to cover at least one connection portion between at least one of the plurality of net members and the at least one frame or between at least two of the plurality of net members.

With this arrangement, connection portions between net members and the frame or between net members can be concealed to thereby improve the external appearance of the main board.

According to a second aspect of the present invention, there is provided a percussion instrument comprising a base, a first support member, a second support member, a first drum board supported by the base via at least the first support member so as to be movable relative to the base, and a second drum board supported by the base via at least the second support member so as to be movable relative to the base, wherein the first and second drum boards are configured to be changeable, via the first and second support members, between an unfolded configuration suitable for a musical performance and a folded configuration suitable for storage, and wherein when the first and second drum boards are in the folded configuration, they are stacked to each other at a fixed position and disposed closer to each other than when they are in the unfolded configuration.

With this arrangement, the drum boards are made closely stacked to each other by being folded, whereby compact storage of the percussion instrument can be realized.

The second support member can have a free end and a proximal end and can be mounted at the proximal end to the first support member such that the free end thereof is displaceable in position, and the second drum board can be mounted to the free end of the second support member so as to be variable in angle relative to the free end of the second support member.

With this arrangement, as compared to an arrangement where the second support member is directly coupled to the base, the second support member can be smaller in size, contributing to compacting the percussion instrument.

The base can be a main board on which a plurality of drum boards other than the first and second drum boards are held.

With this arrangement, the drum boards can be held stably.

The first and second drum boards can be more parallel to the base when they are in the folded configuration than when in the unfolded configuration.

With this arrangement, the percussion instrument can be made compact at the time of storage as viewed from the thickness direction of the main board.

Both the first and second drum boards can be disposed within the outer periphery of the base as viewed from front of the base when they are in the folded configuration.

With this arrangement, the percussion instrument can be made compact at the time of storage in the direction in which the player-side surface of the main board extends (as viewed from front).

According to a third aspect of the present invention, there is provided a percussion instrument comprising a base, a first stay, a second stay, a first drum board supported by the base via at least the first stay so as to be movable relative to the base, and a second drum board supported by the base via at least the second stay so as to be movable relative to the base, wherein the first and second drum boards are configured to be changeable, via the first and second stays, respectively, between an unfolded configuration suitable for a musical performance and a folded configuration suitable for storage, and wherein when the first and second drum boards are in the folded configuration, they are stacked to each other at a fixed position and are disposed closer to each other than in the unfolded configuration.

With this arrangement, the drum boards can be made closely stacked to each other by being folded, whereby compact storage of the percussion instrument can be realized.

According to a fourth aspect of the present invention, there is provided an electronic percussion instrument comprising a main board having a player-side surface thereof adapted to face a player when the main board is vertically arranged for musical performance, a circular or polygonal frame provided in the player-side surface of the main body and formed into a drum shell shape as viewed from the player, a percussion unit provided in the player-side surface of the main board in a region within the frame of the main board, and a sound generation unit disposed within the frame of the main board avoiding a location where the percussion unit is disposed, as viewed from the player.

With this arrangement, wiring connection can be simplified by making external wiring to the sound generation unit unnecessary, while ensuring that the sound generation unit is protected from being struck.

According to a fifth aspect of the present invention, there is provided an electronic percussion instrument comprising a main board having a player-side surface thereof adapted to face a player when the main board is vertically arranged for musical performance, a casing provided in the main board and formed into a drum shape, a percussion unit provided in the player-side surface of the main board on a player side of the casing, and a board disposed within the casing.

With this arrangement, wiring connection can be simplified.

The percussion instrument can further include a sound generation unit disposed within the casing avoiding a location where the percussion unit is disposed, as viewed from the player.

With this arrangement, wiring connection can be simplified by making external wiring to the sound generation unit unnecessary and by shortening wiring to the sound generation unit, while ensuring that the sound generation unit is prevented from being struck.

A plurality of the sound generation units each provided with a sounding section can be provided, each sound generation unit can be disposed such that the sounding section thereof is directed toward the player.

With this arrangement, it is possible to enhance the reality of sound generation.

According to a sixth aspect of the present invention, there is provided an electronic percussion instrument comprising a base, at least one support member having a free end and a proximal end thereof, the support member being mounted at the proximal end to the base such that the free end of the support member is displaceable in position, at least one drum board mounted to the free end of the support member, and a sound generator unit disposed in the base on a player side of the proximal end of the support member and configured to generate a musical tone in response to the drum board being struck.

With this arrangement, it is possible to generate a musical tone near from a striking position, thereby increasing the reality.

The base can be a main body having a player-side surface adapted to face a player when the main board can be vertically arranged for a musical performance, the support member can be configured so as to be pivotable around the proximal end in a direction in which the player-side surface of the base extends, and when the support member rotates around the proximal end, the drum board can be changeable between an unfolded configuration suitable for a musical performance in which the drum board is moved away from the base and a folded configuration suitable for storage in which the drum board is disposed close to and facing the base.

With this arrangement, the electronic percussion instrument can be made compact for storage as viewed in the direction in which a player-side surface of the main board extends (as viewed from front).

A plurality of the support members, a plurality of the drum boards, and a plurality of the sound generator units can be provided so as to correspond to one another, each of the plurality of the sound generator units can be disposed in the base on a player side of the proximal end of a corresponding one of the support members and configured to generate a musical tone in response to a corresponding one of the drum boards being struck.

With this arrangement, each drum board is assigned with at least one sound generator unit, and when any of the drum boards is struck, a musical tone can be generated from the at least one assigned sound generator unit, whereby the reality can further be increased.

The percussion instrument can further comprise a stand configured to hold the main board in a vertically standing state, wherein the stand can include an auxiliary member having one end and another end, the stand can include a leg member having one end, another end, and an intermediate portion between the one end and the other end, the auxiliary member can be pivotably coupled at the one end thereof to the main board and the other end of the auxiliary member can be pivotable around the one end thereof, the leg member can be pivotably coupled at the intermediate portion thereof to the other end of the auxiliary member, the leg member of the stand can be provided at the one end thereof with an engagement portion, the main board can be provided with a counterpart engagement portion thereof corresponding to the engagement portion of the leg member, the main board can be brought into the vertically standing state by engaging the engagement portion of the leg member with the counterpart engagement portion of the main board and by causing the leg member to have an orientation in which the other end of the leg member receives a force from a floor, and the leg member and the auxiliary member are brought into a folded state by releasing the engagement between the engagement portion and the counterpart engagement portion and by making the leg member close to the main board to thereby cause the leg member to be much parallel to the main board than when the main board is in the vertically standing state.

With this arrangement, the main board can be set up into and held in the vertically standing state by a simple operation, and can be made compact for storage.

At least one pair of the leg members, at least one pair of the auxiliary members, at least one pair of the engagement portions, and at least one pair of the counterpart engagement portions can be provided symmetrically on front and rear sides of the main board, with the main board interposed therebetween.

With this arrangement, a lower edge of at least that part of the main board in which the leg members are provided can be made floating when the main body is in the vertically standing state.

The percussion instrument can further include a fitting portion fixedly provided relative to the main board, and a counterpart fitting portion provided in the auxiliary member so as to be fitted in the fitting portion when the main board is brought into the vertically standing state.

With this arrangement, the main board can stably be maintained in the vertically standing state.

The percussion instrument can further include a fitting portion fixedly provided relative to the main board, and a counterpart fitting portion provided in the leg member so as to be fitted in the fitting portion when the leg member and the auxiliary member are brought in the folded state.

With this arrangement, the leg member and the auxiliary member can stably be maintained in the folded state.

The engagement portion of the leg member can include a first contact portion that receives a downward force from the counterpart engagement portion when the main board is in the vertically standing state, and a second contact portion that receives from the counter part engagement portion a force exerting toward the leg member when the main board is in the vertically standing state.

With this arrangement, the main board can be vertically stood and maintained in the vertically standing state with a simple construction.

The above and other objects, features, and advantages of the invention will become more apparent from the following detailed description taken in conjunction with the accompanying drawings.

DETAILED DESCRIPTION OF THE PREFERRED EMBODIMENT

The present invention will now be described in detail with reference to the drawings showing a preferred embodiment thereof.

Figure 1:
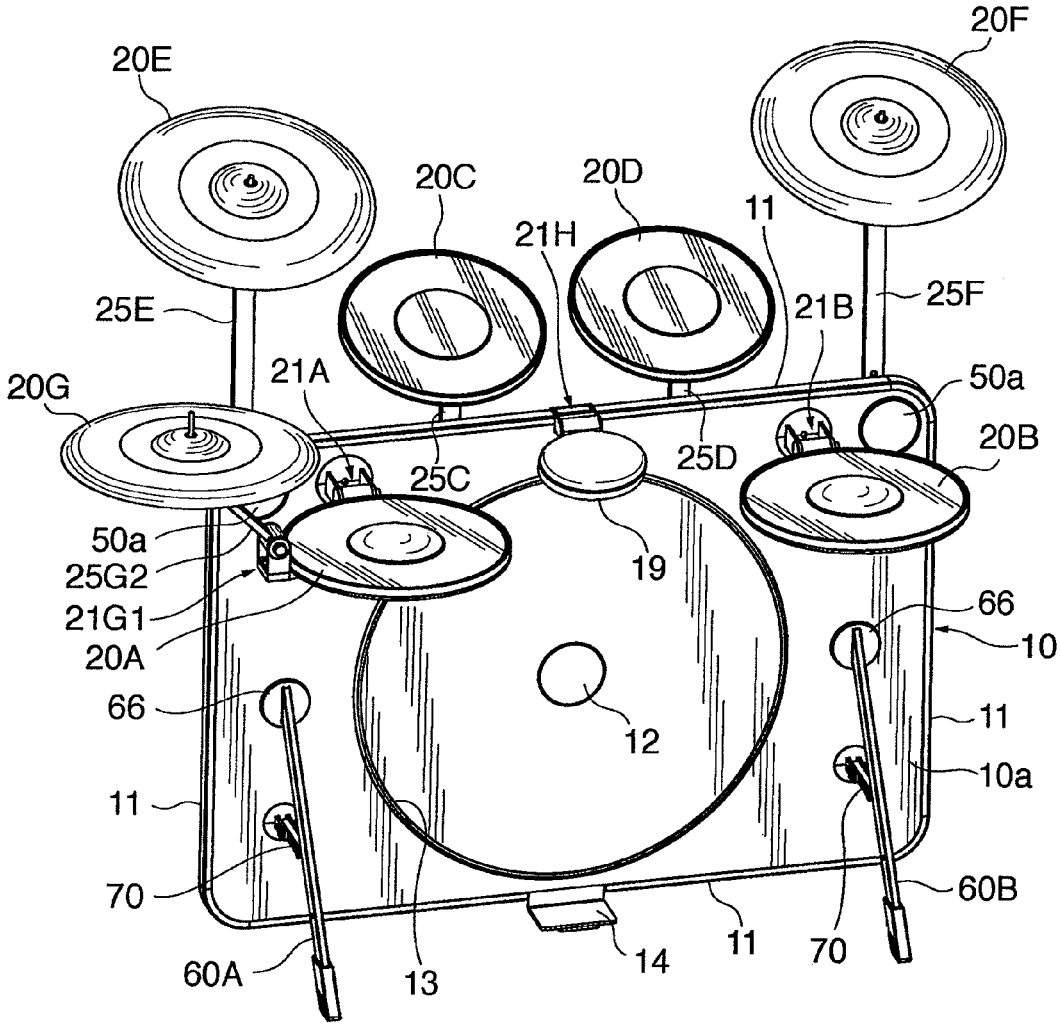
FIG. 1 is a perspective view of a percussion instrument according to one embodiment of the present invention, as viewed from a player.
Figure 2:
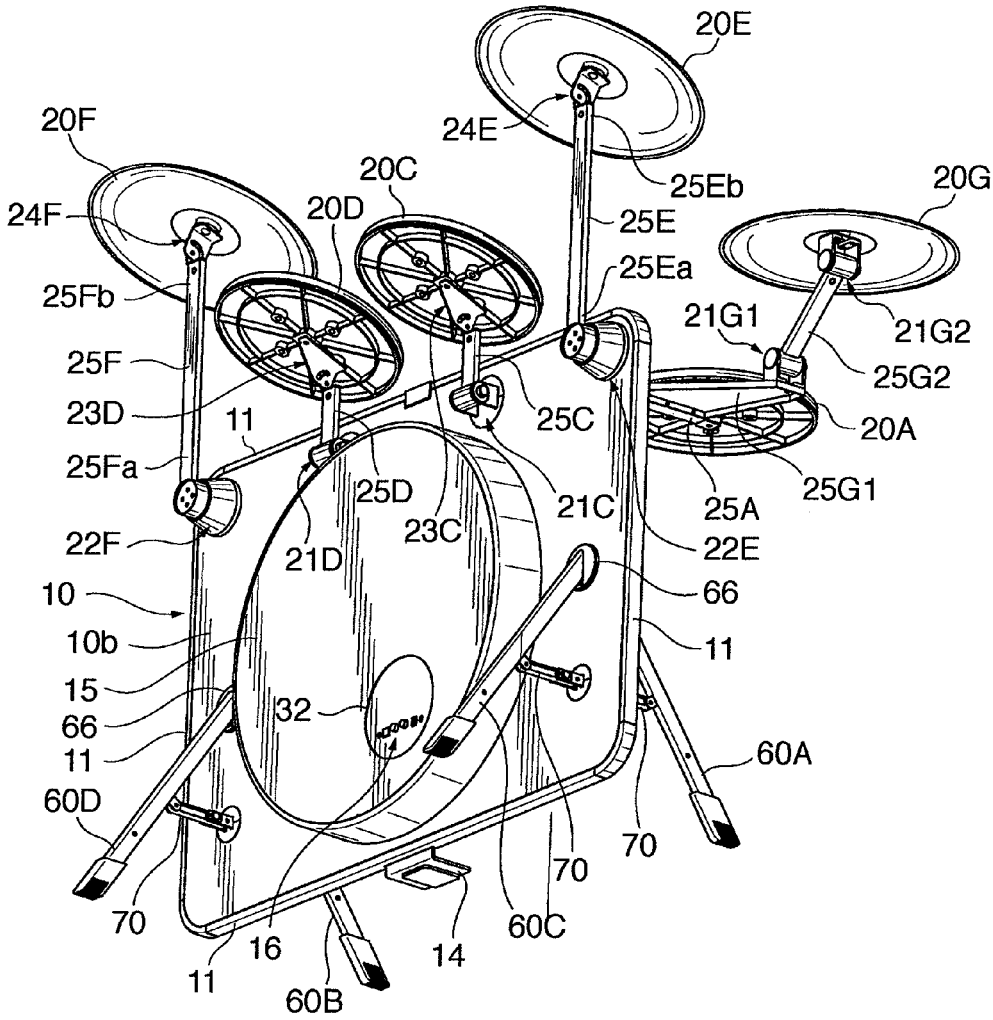
FIG. 2 is a perspective view of the percussion instrument as viewed from audiences.

FIGS. 1 and 2 are perspective views showing a percussion instrument according to one embodiment of this invention. The percussion instrument is configured as an electronic drum. In the following, a side of the percussion instrument toward a player will be referred to as the "player side" or the "front side," and another side of the percussion instrument toward audiences will be referred to as the "audience side" or the "rear side."

The forward, backward, leftward, and rightward directions of the percussion instrument are determined in reference to the player. FIGS. 1 and 2 are views seen obliquely from the player side and the audience side, respectively.

The percussion instrument includes a main board (base) 10 and a plurality of drum boards 20 (20A to 20G, in which suffixes A to G are used to distinguish the individual drum boards from each other) each adapted to be struck. As will be described in detail below, the drum boards 20 are unfoldable from and foldable to the main board 10 and configured to be changeable between a "unfolded state" suitable for a musical performance and a "folded state" suitable for storage. In FIGS. 1 and 2, the unfolded state is shown.

Figure 3:
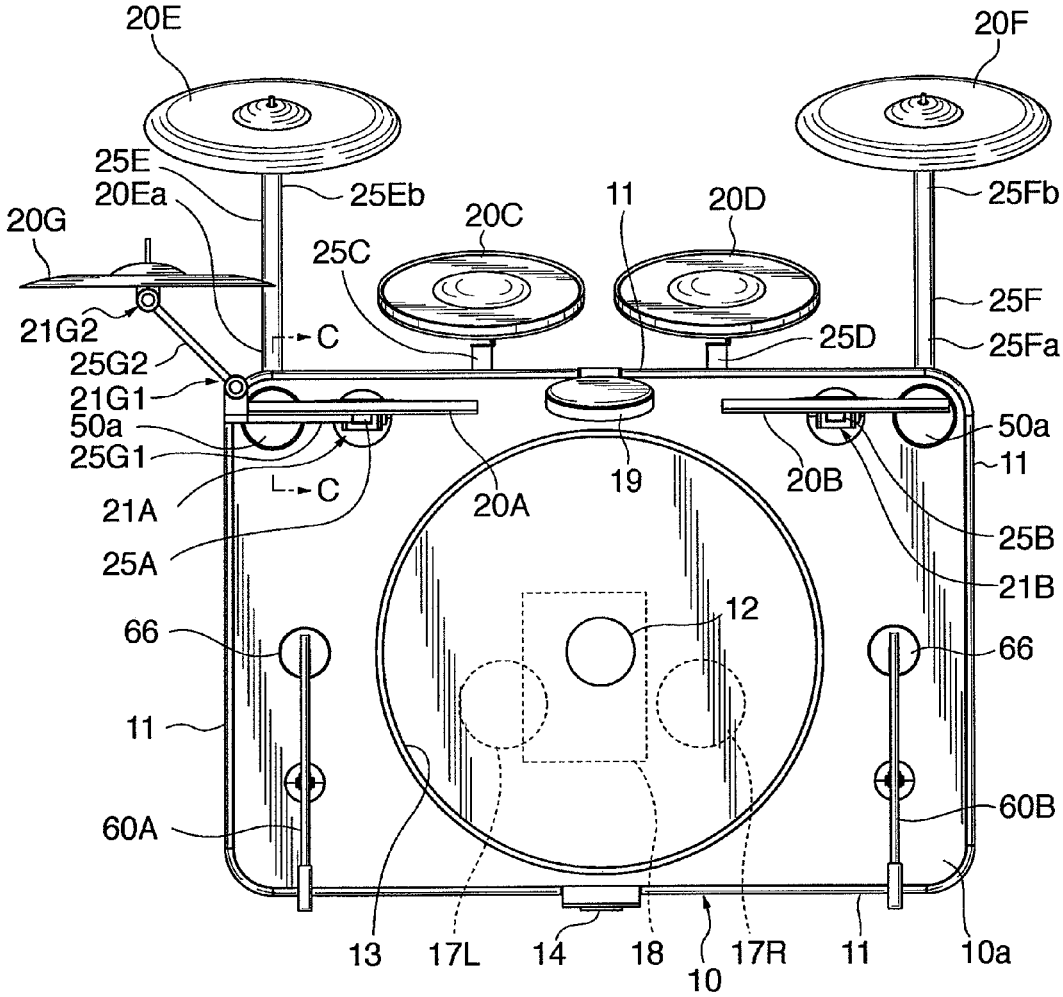
FIG. 3 is a front view showing the percussion instrument in an unfolded state as viewed from the player side.
Figure 4:
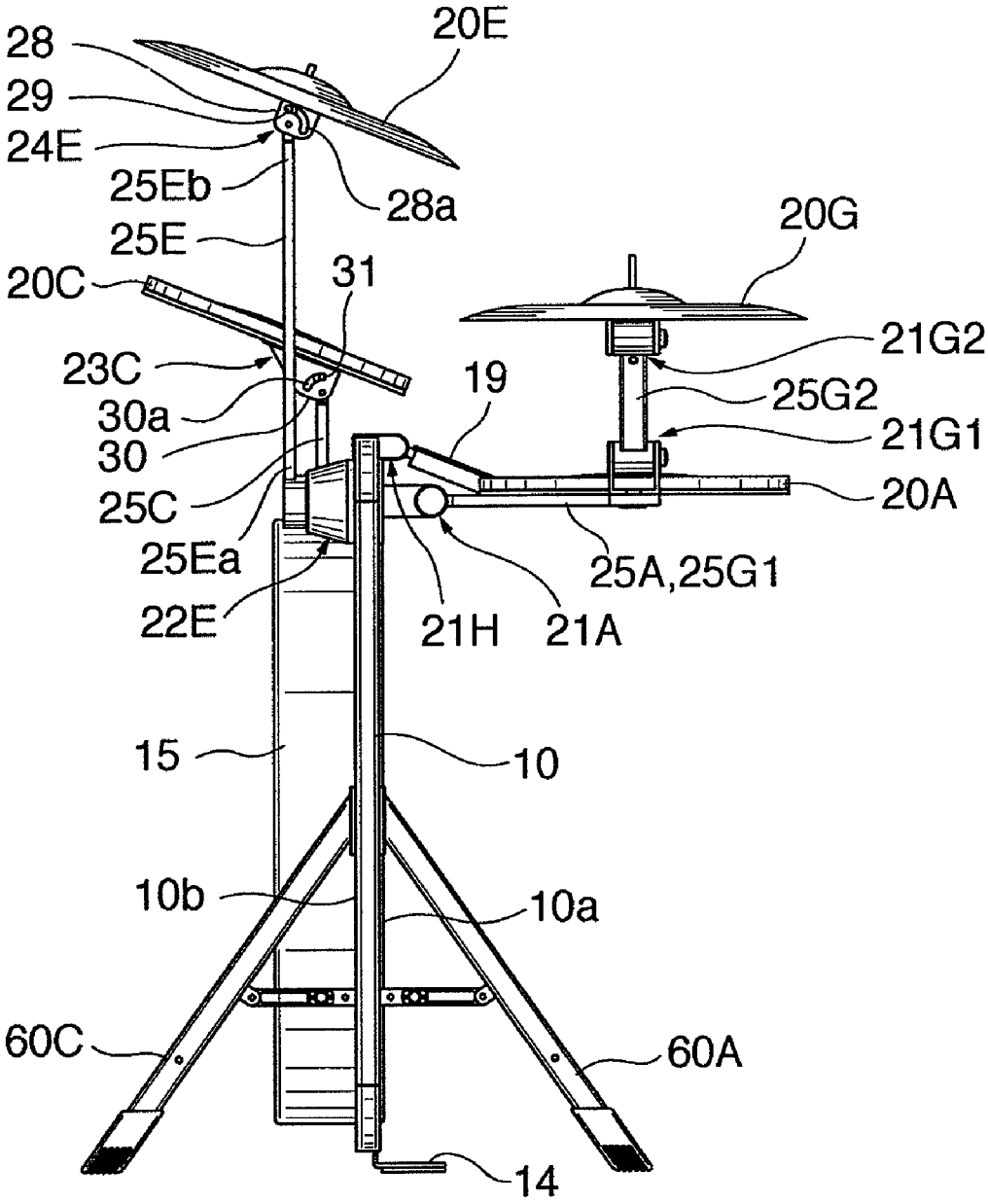
FIG. 4 is a left side view showing the percussion instrument in the unfolded state.
Figure 5:
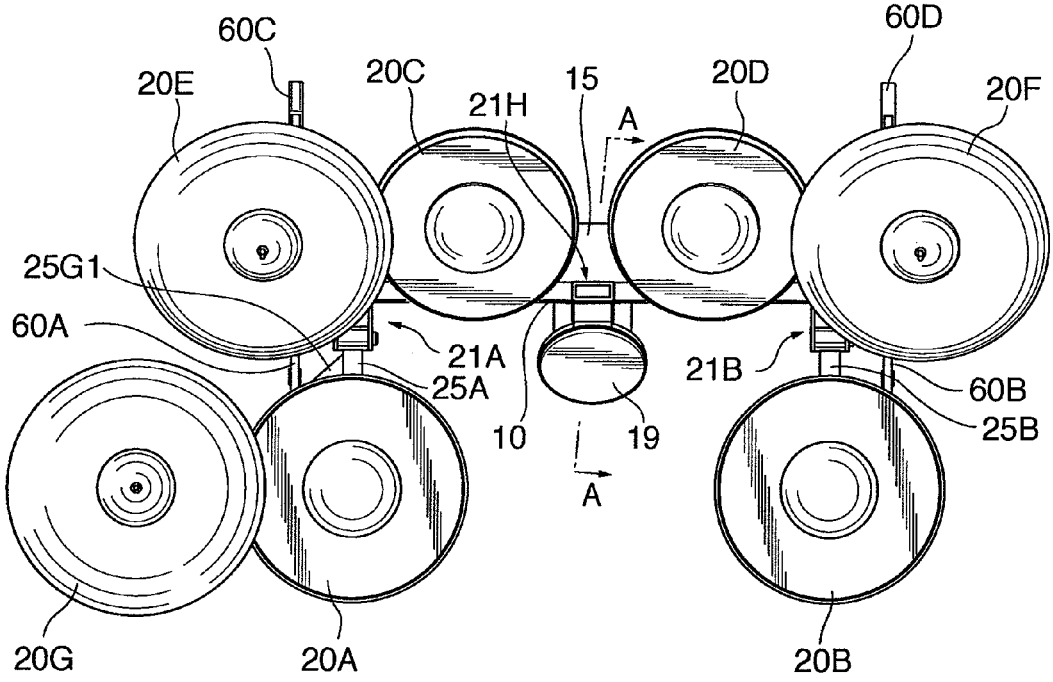
FIG. 5 is a plan view showing the percussion instrument in the unfolded state.
Figure 6:
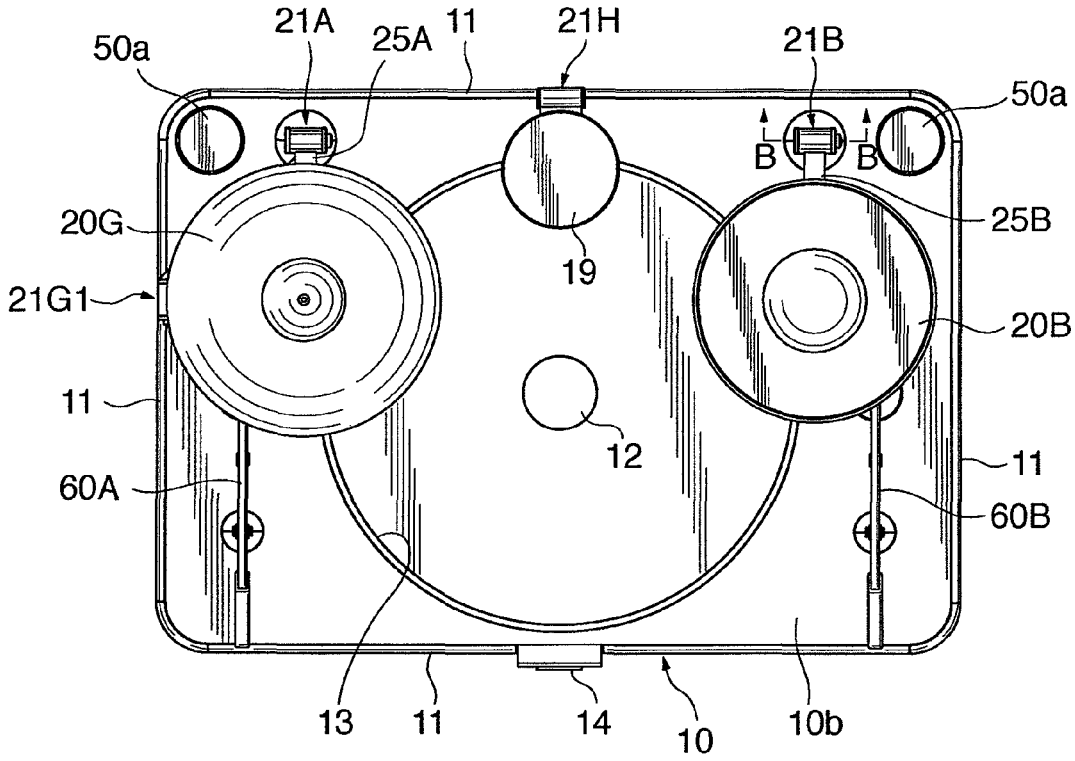
FIG. 6 is a front view showing the percussion instrument in a folded state.
Figure 7:
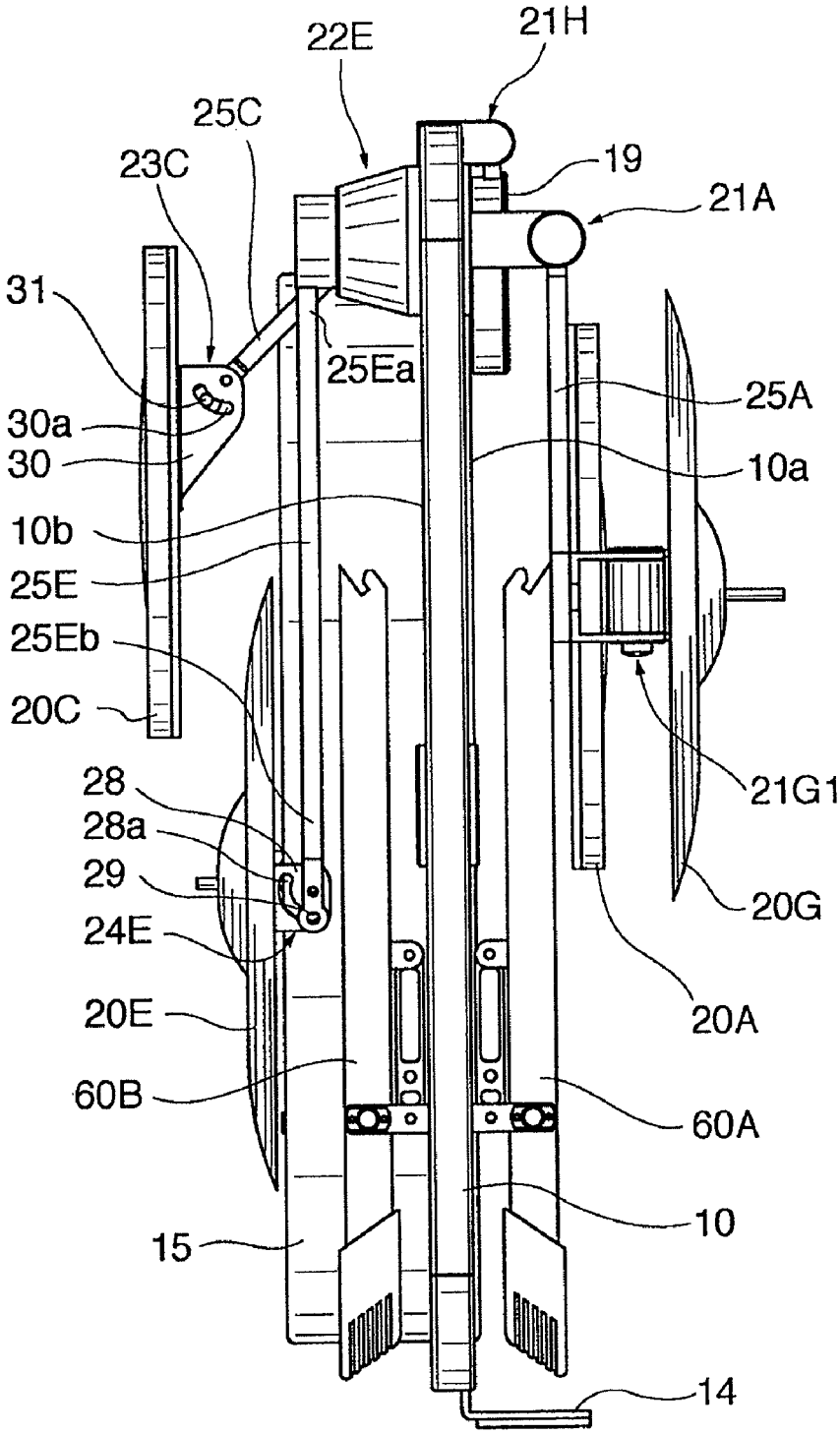
FIG. 7 is a left side view showing the percussion instrument in the folded state.
Figure 8:
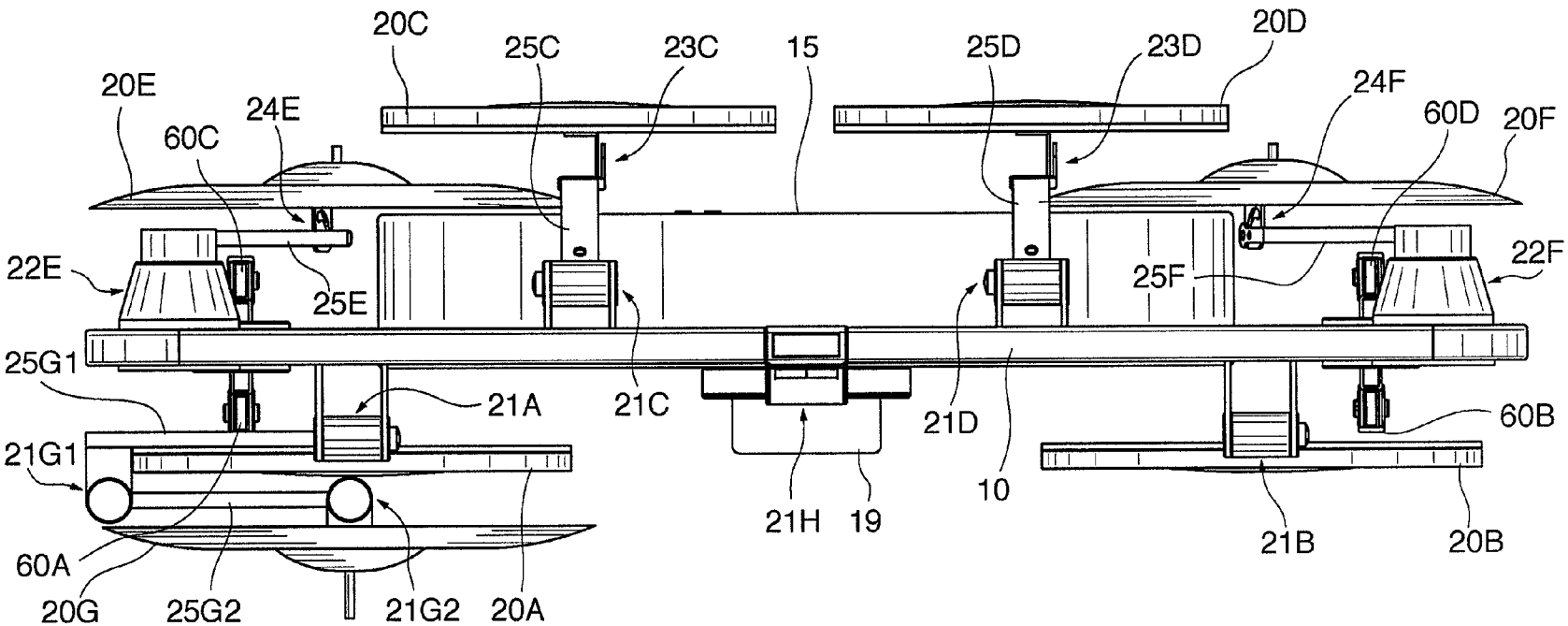
FIG. 8 is a plan view showing the percussion instrument in the folded state.

FIGS. 3 to 5 are a front view (viewed from the player side), a left side view, and a plan view showing the percussion instrument in the unfolded state, respectively. FIGS. 6 to 8 are a front view, a left side view, and a plan view showing the percussion instrument in the folded state, respectively.

The main board 10 is made of a wood material or the like, is formed into a plate shape, and has an outer periphery 11 thereof having a horizontally elongated rectangular shape as seen from front (refer to FIGS. 3 and 6). Legs 60A, 60B as leg members are provided in a lower half of left and right end portions of a player-side surface 10*a* of the main board 10. Legs 60*c*, 60D as leg members are provided in left and right end portions of an audience-side surface 10*b*. When the main board 10 is in a vertically standing state, the main board 10 is vertically arranged by being supported by the four legs 60, with a lower edge of the main body 10 spaced from a floor surface (refer to FIGS. 1-5). The player-side surface 10*a* and the audience-side surface 10*b* are parallel to each other.

The drum boards 20 are each adapted to be struck by a drum stick, not shown. As shown in FIG. 1, the drum board (first drum board) 20A and the drum board 20B are disposed on the player side of the main board 10 at a distance from each other in the left-to-right direction. The drum boards 20C, 20D; 20E, 20F are disposed on the audience side of the main board 10 at a distance from each other in the left-to-right direction. The drum board (second drum board) 20G is disposed close to the drum board 20A. In the unfolded state, the drum board 20G is disposed upward and leftward of the drum board 20A. An operation panel unit 19 is disposed on the player-side of the main board 10 at an upper part of the main body at the center in the left-to-right direction. A foot pedal mounting part 14 is provided in a lower portion of the main body 10 so as to project toward the player side.

Figure 9:
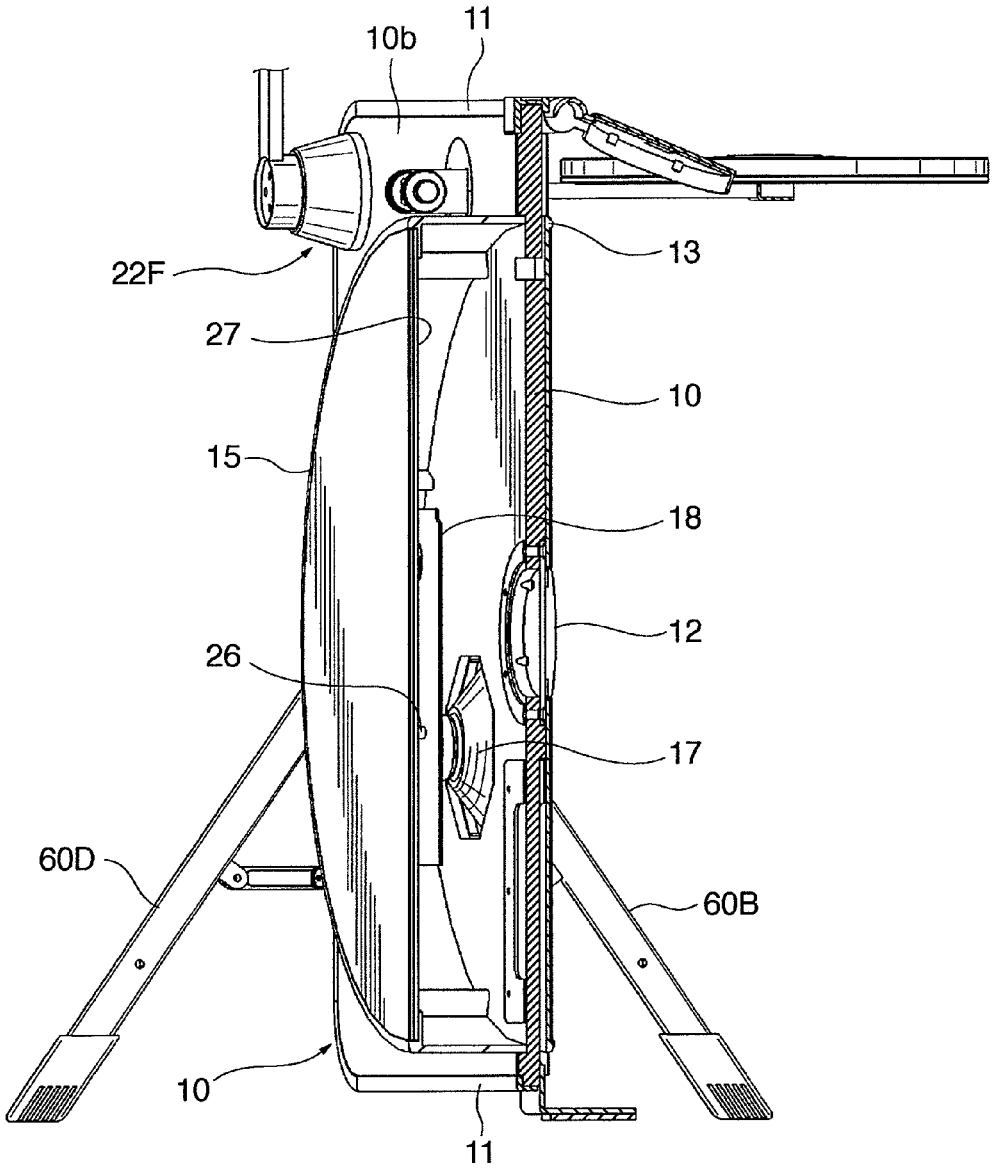
FIG. 9 is a section view taken along line A-A in FIG. 5.

FIG. 9 is a section view taken along line A-A shown in FIG. 5. As shown in FIGS. 2 and 9, a casing 15 is provided on a central part of the audience side of the main board 10. The casing 15 projects toward the audience side from the audience-side surface 10*b* of the main board 10 and a space is defined in the interior of the casing 15. As seen from the audience side, the casing 15 is formed into a circular bass drum shape as in an ordinary acoustic drum set, and has a diameter thereof which is nearly equal to that of a bass drum shell (refer to FIG. 2). Thus, the casing 15 recalls a bass drum in an acoustic drum set, as seen from the audience side.

As shown in FIGS. 1, 3, 6 and 9, a circular frame 13 having the same diameter as the outer diameter of the casing 15 is provided in the player-side surface 10*a* of the main board 10. The frame 13 is formed into the shape of a bass drum shell as seen from front, to thereby recall a bass drum in an acoustic drum set as viewed from the player side. The frame 13 is not limited to being formed into a circular shape, and may be formed into a polygonal shape. A bass drum board (percussion unit) 12 is fixedly disposed in the center of the frame 13 on the player-side surface 10*a* of the main board 10.

A foot pedal, not shown, is mounted to the foot pedal mounting part 14. The bass drum board 12 is adapted to be struck by a beater (not shown) which is caused to move when the foot pedal is operated downward.

As shown in FIGS. 3 and 9, a circuit board (hereinafter referred to as the "board") and left and right speakers 17 (17L, 17R) serving as a sound generation unit are housed in the casing 15. As shown in FIG. 9, a back plate 27 is provided inside the audience-side surface of the casing 15, and the board 18 is mounted to the back plate 27 via a plurality of mounting parts 26. The speakers 17 are mounted to the main board 10, with their sounding sections directed to the player side so as to emit sounds toward the player. As shown in FIG. 3, the two speakers 17 are disposed within the frame 13 as viewed from front, avoiding a location where the bass drum board 12 is disposed, whereby the speakers 17 are protected from affection of the bass drum board 12 being struck. The speakers 17 may be disposed at any other position so long as within the frame 13 while avoiding a location where the bass drum board 12 is disposed.

As shown in FIG. 2, a group of terminals are provided at a left lower part of the audience-side surface of the casing 15. The group of terminals are disposed in a marking portion on the casing 15. The group of terminals include a USB terminal, a head phone terminal, a hi-hat terminal, a power supply terminal, etc., for example. The group of terminals 16 may be positioned so as to be superimposed on the board 18 as viewed from front.

The bass drum board 12 is disposed at a location corresponding to a central part (a mainly struck part) of a bass drum of an acoustic drum set. In the unfolded state, the drum boards 20A to 20G are disposed at locations respectively corresponding to a snare drum, a floor tom, a tom-tom (small), a tom-tom (large), a crash cymbal (side cymbal), a ride cymbal (top cymbal), and a hi-hat cymbal in an ordinary drum set.

Figure 10:
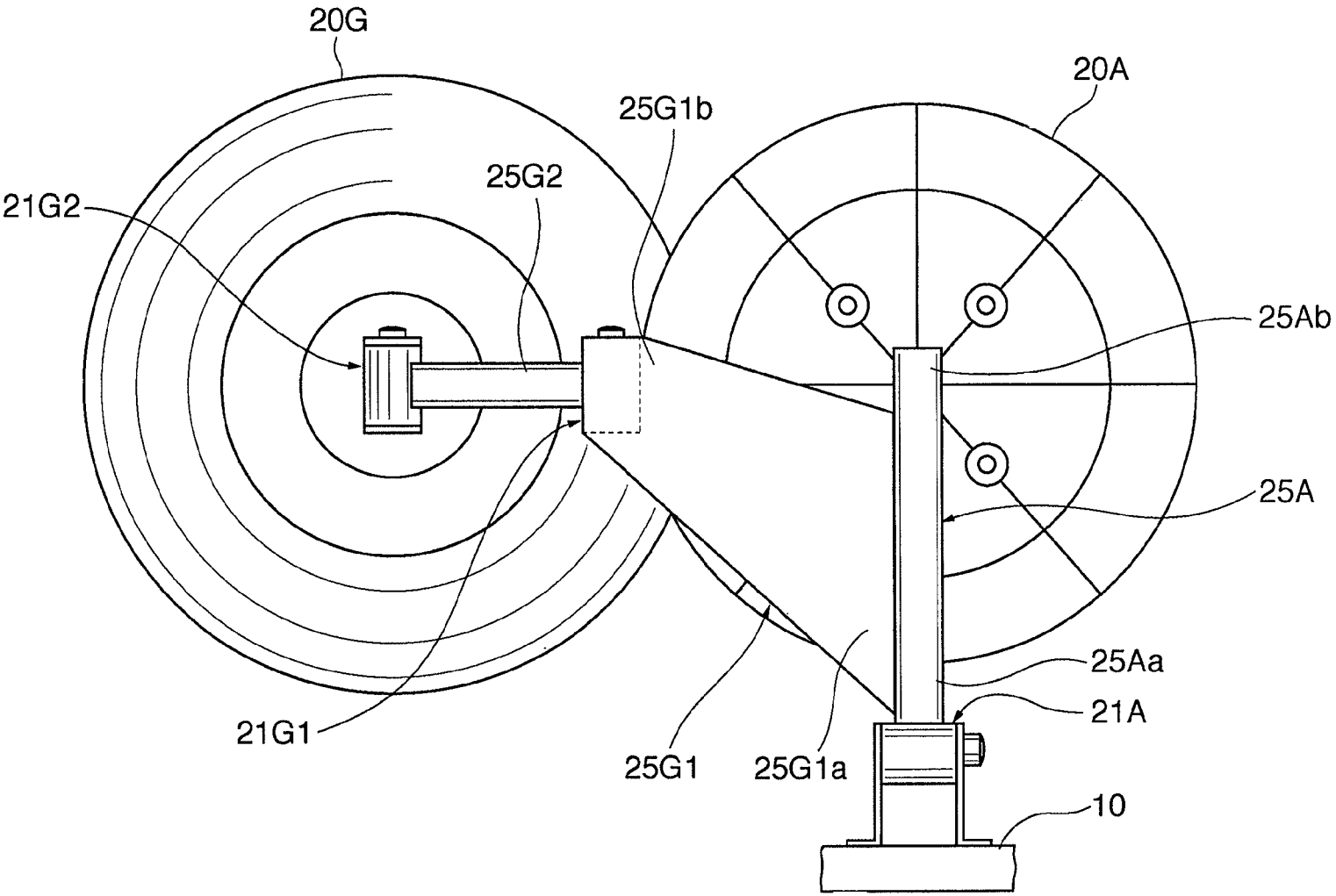
FIG. 10 is a fragmentary bottom view showing two drum boards.

In the percussion instrument of this embodiment, there are provided two types of pivoting mechanism units, i.e., first and second pivoting mechanism units 21 and 22, for making the drum board 20 and the operation panel unit 19 unfoldable from and foldable to the main board 10. As shown in FIG. 1, first pivoting mechanism units 21A, 21B are mounted to near upper left and right end portions of the player-side surface 10*a* of the main board 10, and a first pivoting mechanism unit 21H is mounted to an upper center portion of the player-side surface 10*a* in the left-to-right direction. As shown in FIG. 2, second pivoting mechanism units 22E, 22F are mounted to upper left and right end portions of the audience-side surface 10*b* of the main board 10. First pivoting mechanism units 21C, 21D are mounted to an upper portion of the audience-side surface 10*b* inwardly of the second pivoting mechanism units 22E, 22F in the left-to-right direction. First pivoting mechanism units 21G1, 21G2 (refer to FIG. 8), which will be described in detail below with reference to FIG. 10, are not attached to the main board 10.

The drum boards 20A to 20D are coupled to the first pivoting mechanism units 21A to 21D through an arm (first support member and first stay) 25A and arms 25B to 25D serving as support members, so as to be pivotable in the vertical direction (along a surface extending perpendicular to the left-to-right direction) (refer to FIGS. 2, 5 and 6). As a result, the drum boards 20A, 20B are pivotable in a pivotal range of at least 90 degrees covering from a state where they extend at least perpendicular to the main board 10 (refer to FIG. 4) to another state where they are nearly in parallel to the main board 10 (refer to FIG. 7). On the other hand, the drum boards 20C, 20D are pivotable in pivotal range of about 180 degrees covering from a state where they extend upward perpendicular to the main board 10 (refer to FIG. 4) to another state where they are nearly in parallel to the main board 10 (refer to FIG. 7).

The operation panel unit 19 is coupled to the first pivoting mechanism unit 21H so as to be pivotable in the vertical direction (along a surface extending perpendicular to the left-to-right direction) in a pivotal range of about 90 degrees (refer to FIGS. 1 and 4). In the folded state, the operation panel unit 19 extends in parallel to the main body 10 (refer to FIG. 7).

The drum boards 20E, 20F are coupled through arms 25E, 25F to the second pivoting mechanism units 22E, 22F so as to be pivotable in a surface direction of the main board 10 (in which surfaces of the main board extend and which extends in parallel to the audience-side surface 10*b* and the player-side surface 10*a*) (refer to FIG. 2). Thus, the drum boards 20E, 20F are pivotable in a pivotal range about 180 degrees covering from an angular position where the arms 25E, 25F extend vertically upward from the main board 10 (refer to FIG. 4) to another angular position where they are disposed nearly parallel to each other (refer to FIG. 7). The drum boards 20E, 20F are rotated along tracks on the left and right sides of the main board 10.

Each of the second pivoting mechanism units 22 accommodates therein a speaker 50 (sound generation unit) (described later with reference to FIG. 12). Each speaker 50 includes a sounding section 50*a* thereof disposed at locations corresponding to the second pivoting mechanism units 22 at upper left and right end portions of the player-side surface 10*a* of the main board 10 and directed toward the player so that sounds are sounded toward the player (refer to FIGS. 1, 3, and 6).

In the following, a plurality of drum boards, first pivoting mechanism units, second pivoting mechanism units, and arms which are support members are simply denoted by reference numerals 20, 21, 22, and 25, without being attached with affixes A, B, etc. in a case where they are described without giving any discrimination between individual ones of them. This also applies to the four legs 60. The detailed construction of the first and second pivoting mechanism units 21, 22 and the relationship between these units and the arms 25 will be described later with reference to FIGS. 11A, 11B, and 12.

Although not illustrated, the board 18 is comprised of circuits for musical tone generation such as a tone generator circuit, an amplifier, and an effector circuit. A percussion sensor, not shown, for detection of percussion is provided in each of the drum boards 20 and the bass drum board 12. A detection signal from each percussion sensor is supplied to the board 18 in which the detection signal is converted into a musical tone signal. In the speakers 17, 50, the musical tone signal is further converted into sound which is emitted from the speaker. The operation panel unit 19 is comprised of an LCD or the like. Using the operation panel unit, a user performs the settings of tone color, sound volume, mode, and the like. Wirings through which the drum boards 20, the bass drum board 12, and the operation panel unit 19 are connected to the board 18 extend through the interior of the arms 25 and the main board 10.

The tone colors of musical tones sounded when the drum board 20 and the bass drum board 12 are struck are not needed to be the same as those in an ordinary drum apparatus. The tone colors can arbitrarily set using the operation panel unit 19. The setting for assigning a musical tone to one or more speakers for sounding the musical tone can also be made arbitrarily.

In this embodiment, the assignment is by way of example as follows: The bass drum board 12 is assigned to the left and right speakers 17 to realize sound localization at a position intermediate between the speakers 17. The drum board 20A is assigned to the speaker 17L and the speaker 50 in the second pivoting mechanism unit 22E on the left side, and the drum board 20B is assigned to the speaker 17R and the speaker 50 in the second pivoting mechanism unit 22F on the right side. The drum boards 20C, 20D are assigned to the speakers 17L, 17R, whereas the drum boards 20E, 20F are assigned to the speakers 50 in the second pivoting mechanism units 22E, 22F. The drum board 20G is assigned to the speaker 50 in the second pivoting mechanism unit 22E.

FIG. 10 is a fragmentary bottom view showing the two drum boards 20A, 20G. As described above, the first pivoting mechanism unit 21A is mounted near to the upper left portion of the player-side surface 10*a* of the main board 10 and disposed next to the right side of the sounding section 50*a* of the speaker 50 (FIGS. 1 and 3). As shown in FIG. 10, the arm 25A has a proximal end 25Aa thereof connected to the first pivoting mechanism unit 21A, and a free end 25Ab thereof to which the drum board 20A is mounted in an angularly fixed manner. The drum board 20B is also mounted to a free end of the arm 25B (refer to FIG. 5) in an angularly fixed manner.

As shown in FIG. 10, a plate-like coupling arm (second support member) 25G1 which is triangle as seen from bottom is formed integrally with a left side portion of the arm 25A. Specifically, the coupling arm 25G1 has a proximal end 25G1*a* thereof connected to the left side portion of the arm 25A and a free end 25G1*b* thereof mounted with the first pivoting mechanism unit 21G1. An arm (second stay) 25G2 has a proximal end thereof connected to the first pivoting mechanism unit 21G1 and a free end thereof connected with the first pivoting mechanism unit 21G2 to which the drum board 20G is mounted.

With the above construction, the arm 25G2 is made pivotable around the first pivoting mechanism unit 21G1 in the direction of a surface extending perpendicular to the longitudinal direction of the arm 25A, and the drum board 20G is made pivotable around the first pivoting mechanism unit 21G2 in the direction of a surface that extends perpendicular to the longitudinal direction of the arm 25A. As a result, through the medium of the first pivoting mechanism units 21G1 and 21G2, the drum board 20G can be changed between a position in which it is disposed apart from the drum board 20A in the upper right direction (refer to FIGS. 3-4 and the like) and a position in which it is stacked on the drum board 20A (refer to FIGS. 7-8 and the like).

As shown in FIGS. 2, 4 and 7, pivoting neck portions 23C, 23D are respectively interposed between the free ends of the arms 25C, 25D and the drum boards 20C, 20D. Pivoting neck portions 24E, 24F are respectively interposed between the free ends 25Eb, 25Fb of the arm 25E, 25F and the drum boards 20E, 20F.

As shown in FIGS. 4 and 7, a stay 30 for the pivoting neck portion 23C is fixed to the drum board 20C and coupled to the free end of the arm 25C for rotation along a surface extending perpendicular to the left-to-right direction. The stay 30 is formed into a plate shape and formed with a circular groove 30*a*. A pin 31 is fixedly provided at the free end of the arm 25C and engaged in the circular groove 30*a*. The pivotal range of the drum board 20C relative to the arm 25C is specified by a range in which the pin 31 can be engaged with the circular groove 30*a*.

As shown in FIGS. 4 and 7, a stay 28 for the pivoting neck portion 24E is fixed to the drum board 20E and coupled to the free end 25Eb of the arm 25E for rotation in a surface extending perpendicular to the left-to-right direction. The stay 28 is formed with a circular groove 28*a* similar to the groove 30*a* formed in the stay 30. A pin 29 fixedly provided at the free end 25Eb of the arm 25E is engaged in the circular groove 28*a*.

With the above arrangement, the angles of the drum boards 20C, 20E can be adjusted in the unfolded state. In the folded state, the drum boards 20C, 20E can be made close to the main board 10 in parallel therewith.

The pivoting neck portions 23D, 24F have the same construction as that of the pivoting neck portions 23C, 24E. As in the drum boards 20C, 20E, the arrangement of the drum boards 20D, 20F can also be changed.

The pivoting neck portions 23C, 23D, 24E, 24F are configured to produce friction during the pivotal motion, thereby capable of maintaining the angles of the drum boards 20C to 20F placed at desired positions. This makes it easy to perform folding/unfolding operations as compared to an arrangement in which the angles of the drum boards 20C to 20F relative to the pivoting neck portions 23C, 23D, 24E, 24F are fixed using screws or the like.

The following is a detailed explanation on the first and second pivoting mechanism units 21 and 22. The first pivoting mechanism units 21A to 21H have the same construction from one another. The second pivoting mechanism units 22E, 22F have the same construction except for that they are mirror symmetry as viewed in the left-to-right direction. Thus, by way of example, the constructions of the first and second pivoting mechanism units 21B, 22E will be explained in the following.

Figure 11A:
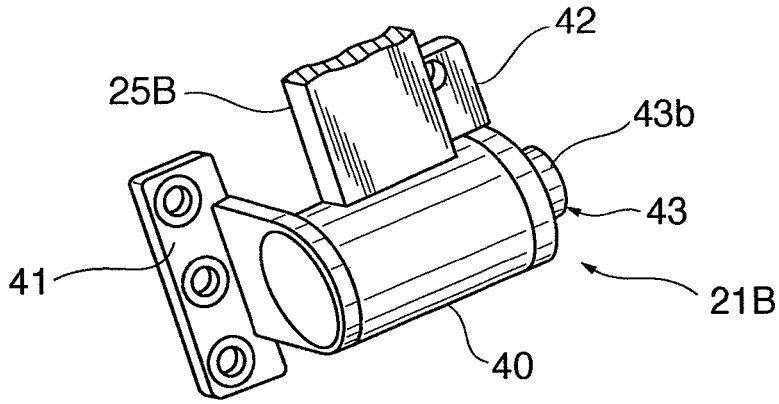
FIG. 11A is a perspective view showing a first pivoting mechanism unit.
Figure 11B:
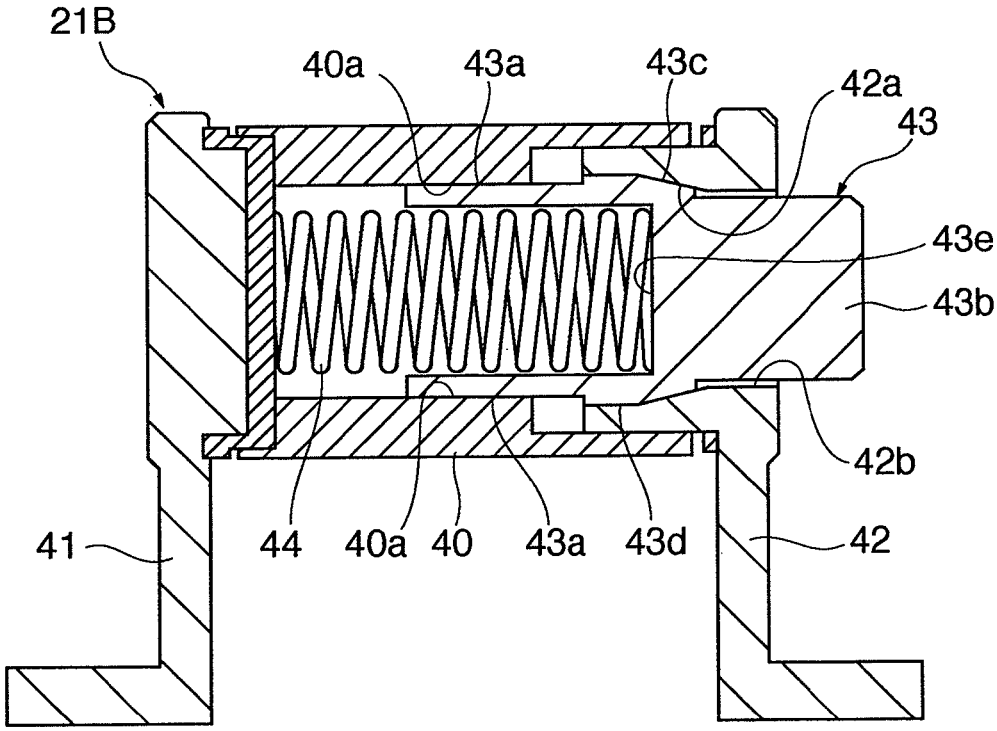
FIG. 11B is a section view of the first pivoting mechanism unit taken along line B-B shown in FIG. 6.

FIG. 11A is a perspective view showing the first pivoting mechanism unit 21B, and FIG. 11B is a section view of the unit 21B taken along line B-B shown in FIG. 6.

As shown in FIG. 11A, the first pivoting mechanism unit 21B includes a pair of stays 41, 42 that are fixed to the main board 10 using screws. A cylindrical member 40 is fixed to the proximal end of the arm 25B. The cylindrical member 40 may be formed integrally with the arm 25B. As shown in FIG. 11B, a push button 43 is partly inserted into the cylindrical member 40, and a pressed portion 43*b* of the push button 43 projects from a through hole 42 formed in the stay 42.

The push button 43 has a cylindrical outer peripheral surface 43*d* thereof supported by the stay 42. A tapered outer peripheral surface 43*c* having a diameter thereof increasing toward the outer peripheral surface 43*d* is formed between the outer peripheral surface 43*d* and the pressed portion 43*b*. The stay 42 is formed with a tapered inner surface 42*a* corresponding to the tapered outer peripheral surface 43*c*.

Two notched surfaces 43*a* are formed in that outer peripheral portion of the push button 43 which is disposed in the interior of the cylindrical member 40 on the side close to the stay 41 with respect to the outer peripheral surface 43*d*. The cylindrical member 40 is formed at its inner periphery with contact surfaces 40*a* corresponding to and extending in parallel to the notched surfaces 43*a*. Since the contact surfaces 40*a* are in contact and in engagement with the notched surfaces 43*a*, the cylindrical member 40 and the push button 43 can be rotated in unison with each other.

The push button 43 has a stay-side half on the side close to the stay 41. The stay-side half is formed with a recess that opens toward the stay 41. A spring 44 is disposed in the recess and in the interior of the cylindrical member 40. The spring 44 urges the contact surfaces 43*e* corresponding to the bottom of the recess toward the stay 42. When no operation is carried out, the spring 44 always causes the tapered surface 43*c* to be in urged contact with the tapered surface 42*a*.

With this arrangement, in order to pivotally rotate the arm 25B, a user pushes the pushed portion 43*b* of the push button 43. As a result, the tapered surface 43*c* is moved away from the tapered surface 42*a*, allowing the user to freely rotate the arm 25B in unison with the cylindrical member 40 and the push button 43 while the pushed portion 43*b* is kept pressed. When the pushed portion 43*b* is released from being pushed after the arm 25B is rotated to an appropriate rotary position, the tapered surface 43*c* is urged in contact with the tapered surface 42*a* again. As a result, the arm 25B is fixed at that rotary position, so that this rotary position is prevented from being changed even if some force is applied.

Figure 12:
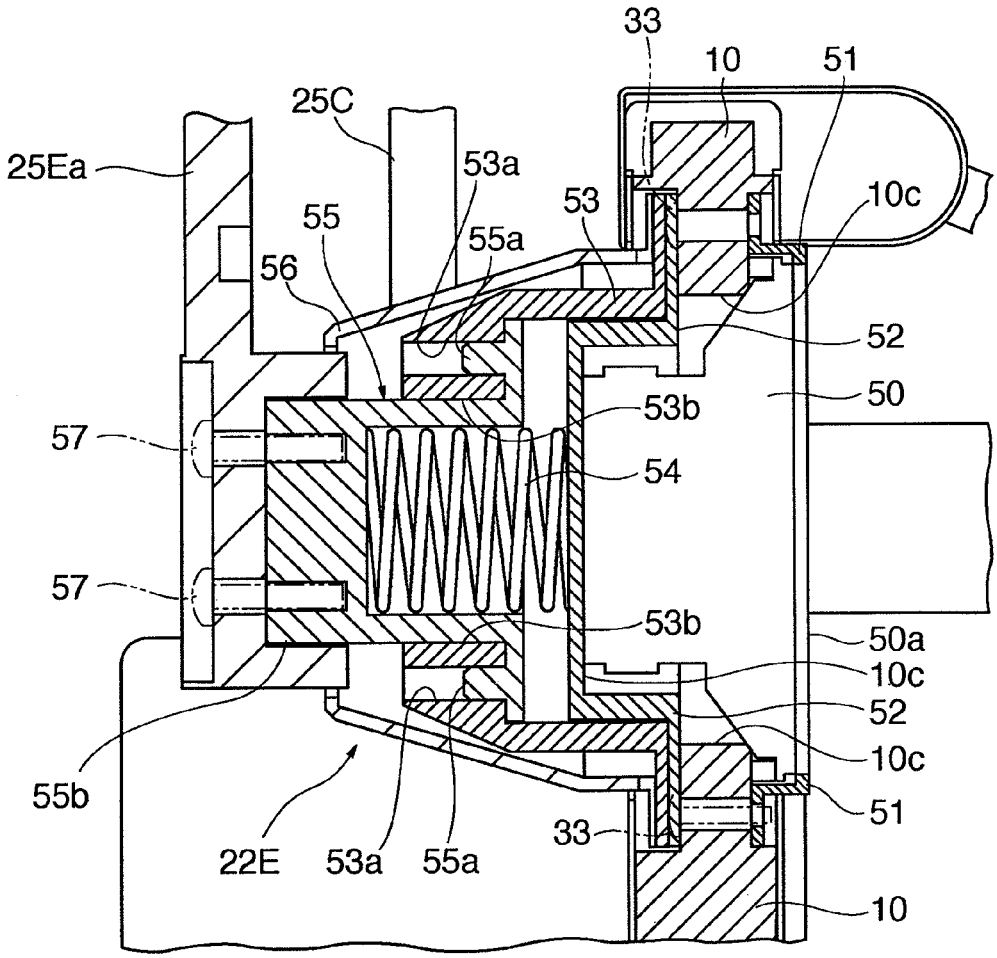
FIG. 12 is a sectional view of a second pivoting mechanism unit taken along line C-C shown in FIG. 3.

FIG. 12 is a sectional view of the second pivoting mechanism unit 22E taken along line C-C shown in FIG. 3. The main board 10 is formed with a speaker mounting hole 10*c* in which the speaker 50 is disposed. A front-side speaker cover 51 is disposed on the player side of the speaker mounting hole 10*c*, whereas a rear-side speaker cover 52 is disposed on the audience side of the speaker mounting hole 10*c*. Both the front-side and rear-side speaker covers 51 52 are fixed, using screws 33, to the main board 10 from audience-side, whereby the speaker 50 is held between the covers.

A fixed interposed member 53 is fitted to an audience side of the rear-side speaker cover 52. The fixed interposed member 53 has a flange thereof fixed, e.g., by thread engagement, to the main board 10 through a flange portion of the rear-side speaker cover 52. A rotary member 55 is engaged with the fixed interposed member 53. Specifically, the rotary member 55 has an audience-side cylindrical head portion 55*b* whose outer peripheral surface is slidably fitted to an audience-side inner peripheral surface 53*b* of the fixed interposed member 53.

The fixed interposed member 53 is formed with a plurality of (eight, for instance) fitting holes 53*a* at regular interval in the circumferential direction of the rotary member 55. On the other hand, the rotary member 55 has a flange portion having an audience side thereof integrally formed with protruding engagement portions 55*a* that can be fitted into the fitting holes 53*a*. The protruding engagement portions 55*a*, which are the same in number as the fitting holes 53*a*, are provided at locations corresponding to the fitting holes 53*a*. The number of the engagement portions 55*a* may be less than that of the fitting holes 53*a*.

The cylindrical head portion 55*b* of the rotary member 55 is formed with a recess that opens toward a player, and a spring 54 is disposed in the recess. The spring 54 is always in contact with the audience-side surface of the rear-side speaker cover 52, and always urges the rotary member 55 toward the audience-side. A rear-side cover 56 is attached to the fixed interposed member 53 from audience side so as to cover the fixed interposed member 53. The rear-side cover 56 has a flange portion thereof fixed, e.g., by thread engagement, to a flange portion of the fixed interposed member 53. A proximal end 25Ea of the arm 25E is fixed to the cylindrical head portion 55*b* of the rotary member 55, using screws 57. Thus, the arm 25E is arranged to be rotated in unison with the rotary member 55. A second pivoting mechanism unit 22F is constructed in the same manner as the second pivoting mechanism unit 22E, and a proximal end 25Fa of the arm 25F is fixed thereto.

The second pivoting mechanism unit 22E is assembled as follows: First, the speaker 50 is disposed in the speaker mounting hole 10*c*, and then the front-side and rear-side speaker covers 51, 52 are attached. On the other hand, with the spring 54 retained in the recess of the rotary member 55 and the rotary member 55 and the fixed interposed member 53 engaged with each other, the flange portion of the fixed interposed member 53 is brought in contact with the flange portion of the rear-side speaker cove 52 from audience side and fixed thereto by thread engagement. At this time, the player-side end of the spring 54 is in urged contact with the rear-side speaker cover 52.

Then, the flange portion of the rear-side cover 56 is brought in contact with the flange portion of the fixed interposed member 53 and fixed by thread engagement against a spring force of the spring 54. Further, the proximal end 25Ea of the arm 25E is fixed to the cylindrical head portion 55*b* of the rotary member 55, using screws 57.

With this arrangement, in order to rotate the arm 25E, the user pushes the proximal end 25Ea of the arm 25E toward the player side such that the protruding engagement portions 55*a* are detached from the fitting holes 53*a*. Then, with the proximal end 25Ea kept pressed, the user rotates the arm 25E to a desired rotary position, and releases the depression on the proximal end 25Ea at the desired rotary position. At this time, usually, the protruding engagement portions 55*a* do not perfectly coincide in position with the fitting holes 53*a*. Thus, the user slightly rotates the arm 25E in either direction without depressing the proximal end 25Ea. When the protruding engagement portions 55*a* coincide in position with the fitting holes 53*a*, they are fitted into the fitting holes 53*a*. As a result, the arm 25E is fixed at that rotary position.

Figure 13A:
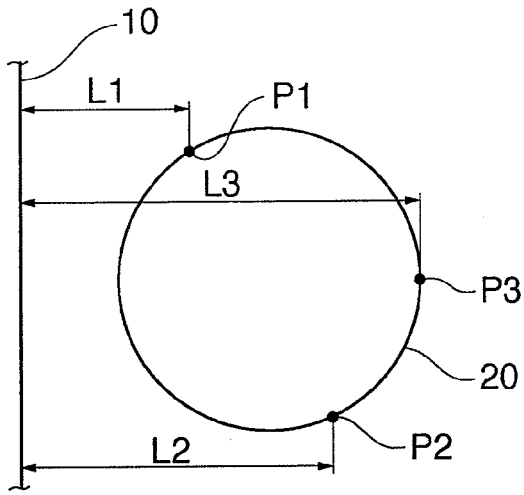
FIG. 13A is a plan view schematically showing the unfolded state and explaining how the distance between a drum board and a main board changes between the unfolded state and the folded state.
Figure 13B:
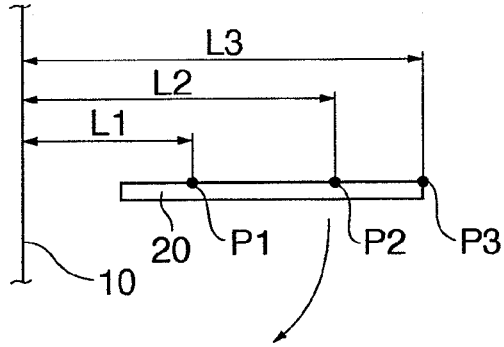
FIG. 13B is a side view schematically showing the unfolded state and explaining how the distance between the drum board and the main board changes between the unfolded state and the folded state.
Figure 13C:
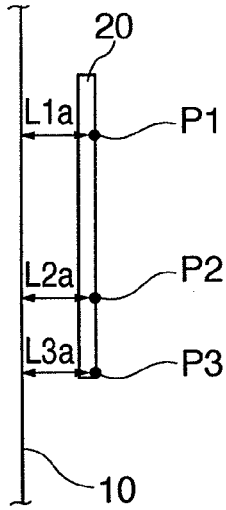
FIG. 13C is a side view showing the folded state and explaining how the distance between the drum board and the main board changes between the unfolded state and the folded state.

FIGS. 13A to 13C are views schematically showing how the distance between one drum board (drum board 20A or 20B) and the main board 10 changes between the unfolded state and the folded state. FIG. 13A shows the unfolded state in a plan view, FIG. 13B shows the unfolded state in a side view, and FIG. 13C shows the folded state in a side view.

The drum board 20A formed into a disk-like shape and having the outer periphery thereof constructed by a numerous number of points is taken as an example, and attention is focused on points P1, P2, and P3 on the outer periphery. It is assumed here that the minimum distances from the points P1, P2, and P3 to the main board 10 in the unfolded state are represented by L1, L2, and L3, respectively (refer to FIGS. 13A and 13B). On the other hand, in the folded state, the minimum distances from the points P1, P2, and P3 to the main board 10 are respectively represented by L1*a*, L2*a*, and L3*a*. The relationship of L1>L1*a*, L2>L2*a* and L3>L3*a* is satisfied.

The above is satisfied for any point P on the outer peripheries of the drum boards 20. With regard to the drum boards 20A and 20B, the total sum of the minimum distances between positions on the outer periphery of the drum board 20 and the main board 10 in respect of all the positions on the outer periphery of the drum board 20 is smaller in the folded configuration than in the unfolded configuration. This indicates that the apparatus can be compact as viewed in the thickness direction of the main board 10 when it is in the folded configuration than in the unfolded configuration (refer to FIGS. 4 and 7).

The just-mentioned magnitude relation of the total sum between the unfolded configuration and the folded configuration is also satisfied with regard to the drum board 20G. The drum boards 20C to 20F may be configured to satisfy the magnitude relationship of the total sum with the assumption that the main board 10 is extended upward.

Out of points on the outer periphery of the drum board 20, the magnitude relationship between the unfolded configuration and the folded configuration may be reversed for some points. With any arrangement configured to satisfy the magnitude relationship of the total sum, it is possible to attain an advantageous effect that the arrangement can easily be made compact in the thickness direction. It should be noted that the magnitude relationship of the total sum can be applied to drum boards which are not circular in shape. For instance, the above is applicable to any points on a fan-shaped outer periphery.

The user makes the drum boards 20 to have the unfolded configuration at the time of performing a musical performance and to have the folded configuration at the time of storage of the instrument. To this end, the drum boards 20A to 20G and the operation panel unit 19 are configured that displacement strokes thereof between the unfolded configuration and the folded configuration do not interfere with one another. This permits the user to unfold and fold the drum boards 20 and the operation panel unit 19 in any order without difficulty.

At the time of performing a musical performance, the main board 10 is vertically arranged such that the player-side surface 10*a* thereof faces the player, and the drum boards 20 and the like are set to have the unfolded configuration. In the following, a stand structure used to vertically arrange the main board 10 will be described.

Figure 14:
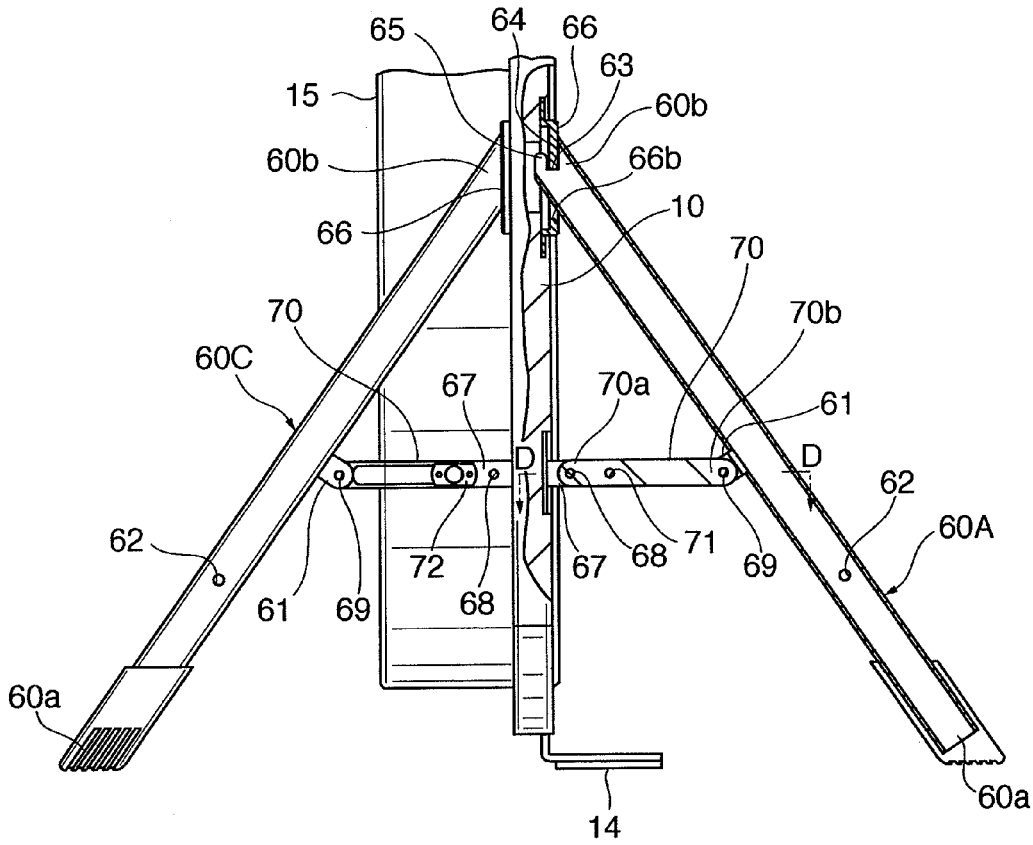
FIG. 14 is a right side view showing, partly in cross section, a lower portion of the percussion instrument in a condition that the main board is in a vertically standing state.
Figure 15:
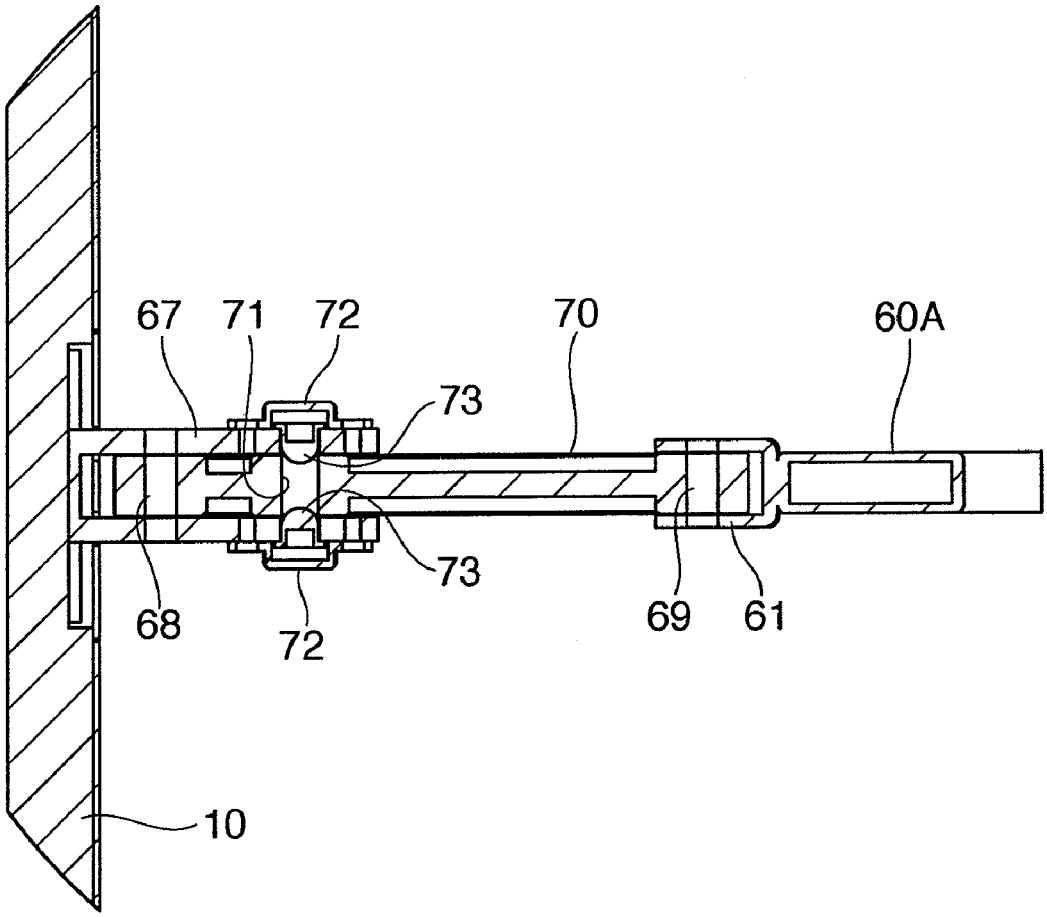
FIG. 15 is a section view taken along line D-D in FIG. 14.
Figure 16A:
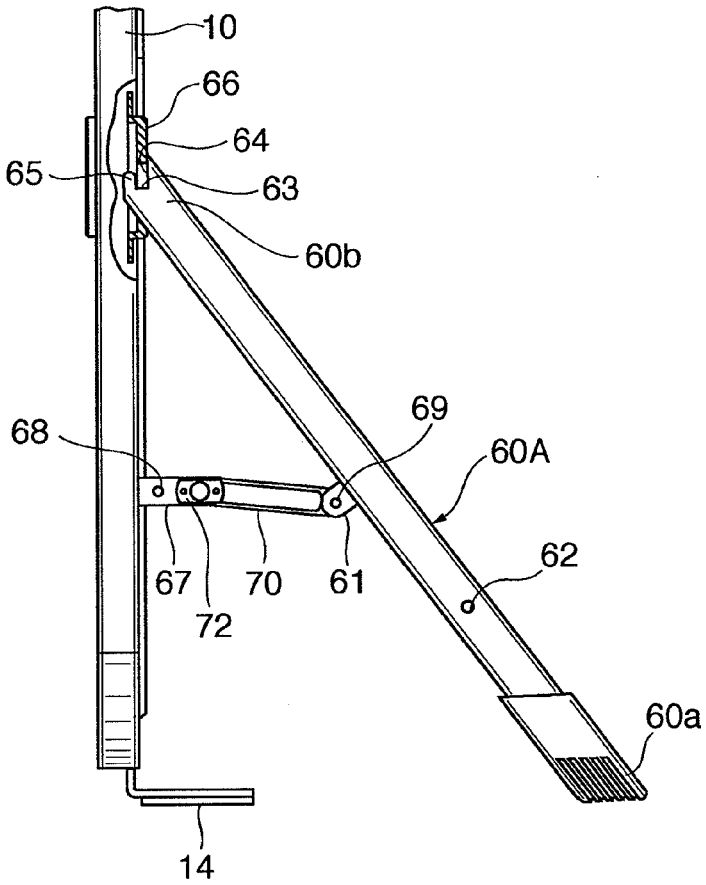
FIG. 16A is a side view showing a lower portion of the percussion instrument during the course in which a leg is changed from in the vertically standing state to in the folded state.
Figure 16B:
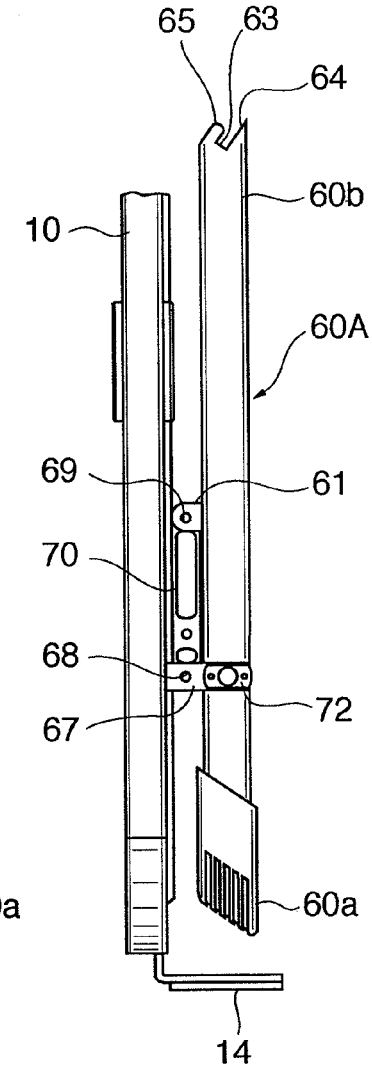
FIG. 16B is a side view showing a lower portion of the percussion instrument in a condition that one leg is in the folded state.

FIG. 14 is a right side view showing, partly in cross section, a lower part of the percussion instrument with the main board 10 vertically arranged, and FIG. 15 is a section view taken along line D-D shown in FIG. 14. In the vertically standing state of the main board 10 shown in FIG. 14, legs 60 are also vertically arranged. Therefore, the term "vertically standing state" or other like term such as "vertical arrangement" and "vertical configuration" in the following indicates that both the main board 10 and the leg 60 are vertically arranged. FIG. 16A is a side view showing the lower part of the percussion instrument during the course from a state where the leg 60A is vertically arranged to a state where it is folded. FIG. 16B is a side view showing the lower portion of the percussion instrument with the leg 60A in the folded state. FIG. 14 shows the same state as that shown in FIG. 4, and FIG. 16B shows the same state as that shown in FIG. 7.

The stand structure is mainly comprised of a plurality of legs 60, a plurality of link arms (auxiliary members) 70, a plurality of projecting stays 67, a pair of simple holding member 72, and a pair of fitments 66. Although the stand structure having the same construction is used at four different places, the leg 60*a* and structural parts corresponding thereto will be described as an example.

As shown in FIG. 14, the leg 60A is formed of metal or the like in an elongated form. In the vertically standing state, a lower end portion 60*a* of the leg 60A is brought in contact with the ground. In a strict sense, the lower end portion 60*a* is made in contact with the ground via a ground contact member attached thereto. An intermediate stay 61 is provided at a longitudinally intermediate portion of the leg 60A so as to project toward the main board 10. An engagement hole (counterpart engagement portion) 62 extending through the leg in the left-to-right direction is formed between the lower end portion 60*a* and the intermediate stay 61. An engagement recess (engagement portion) 63 and a hook portion 65 are formed in an upper end portion 60*b* of the leg 60A.

Figure 17A:
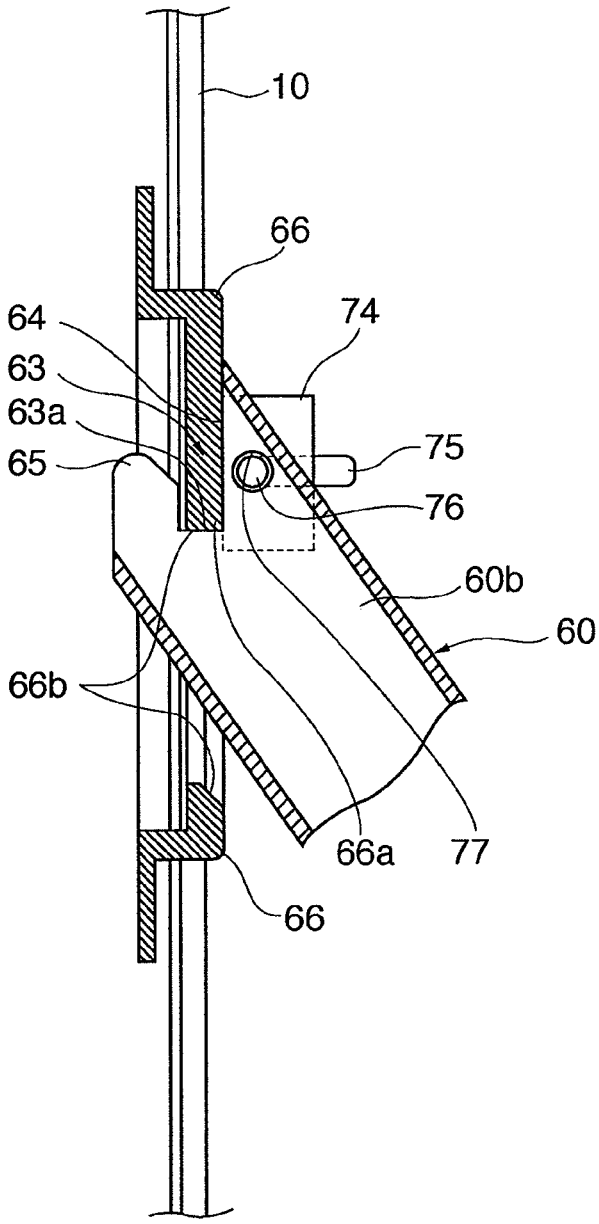
FIG. 17A is a section view showing a modification of an engagement between an upper end portion of a leg and a counterpart fitment.

FIG. 17A shows a modification of the above embodiment, which will be described later but in which the fitment 66, the engagement recess 63 and the hook portion 65 of the leg 60A are the same in construction as the aforementioned embodiment. Thus, the construction of the fitment 66, the engagement recess 63 and the hook portion 65 will be described with reference to FIG. 17A. The engagement recess 63 is formed into a U-shape that opens upward, as seen from side. The engagement recess 63 includes a contact surface (second contact portion) 64 that is configured to face toward the audience side in the vertically standing state, and a horizontal bottom surface (first contact portion) 63*a*. The hook portion 65 is provided so as to project upward from the bottom surface 63*a* on the audience side with respect to the bottom surface 63*a*.

The fitments 66 are mounted to the main board 10. Each fitment 66 is formed with an engagement portion (counterpart engagement portion) 66*a* below which an engagement hole 66*b* is formed so as to allow the hook portion 65 to be inserted into and pulled out from the hole 66*b*. To this end, a slanted surface is formed in a lower surface of the engagement hole 66*b* for easy insertion and pull out of the hook portion 65. The engagement portion 66*a* of the fitment 66 has a thickness such that the engagement portion is loosely fitted into the engagement recess 63.

As shown in FIGS. 14 and 15, projecting stays 67 are fixedly provided in the main board 10 at intermediate locations between the fitments 66 and the foot pedal mounting portion 14. Link arms 70 each have a proximal end 70*a* thereof coupled through a pivot shaft 68 to a distal end of the projecting stay 67 such that each link arm 70 is pivotable around the pivot shaft 68 along a surface extending perpendicular to the left-to-right direction. Each link arm 70 has a free end 70*b* thereof coupled through a pivot shaft 69 to the intermediate stay 61 of the leg 60A. As a result, the leg 60A is made pivotable around the pivot shaft 69 along a surface perpendicular to the left-to-right direction.

A pair of simple holding members 72 are fixed to a distal end portion of the projecting stay 67 on both sides thereof. Protruding portions (fitting portions) 73 are formed in inner sides of the simple holding members 72 so as to face to each other (refer to FIG. 15). On the other hand, the projecting stay 67 is formed with an engagement hole 71 corresponding to the protruding portions 73. In the vertically standing state, both the protruding portions 73 are fitted into the engagement hole 71 such that the corresponding link arm 70 is stabilized at that rotary position. As a result, the leg 60A is also stabilized in the vertically standing state. On the other hand, when the leg 60A is in the folded state, the protruding portions 73 are fitted into the engagement holes 62 of the leg 60A, so that the leg 60A is stabilized in the folded state (refer to FIG. 16B). The engagement/disengagement between the protrusion portions 73 and the engagement holes 71, 62 can be carried out when a force to move the leg 60A is intentionally applied by the user.

With the above construction, a plurality of the legs 60 are vertically arranged and folded as follows: First, in the folded state shown in FIG. 16B, the lower portion 60*a* of the leg 60A is pulled by the user in the direction away from the main board 10, with the lower end portion 60*a* grasped. As a result, the engagement between the protrusion portion 73 of the simple holding member 72 and the engagement hole of the leg 60A is released. When the lower end portion 60*a* is further pulled, the corresponding link arm 70 is pivoted in the clockwise direction in FIG. 16A, and the leg 60A is pivoted in the direction away from the main board 10, i.e., in the counterclockwise direction.

Subsequently, the leg 60A is operated by the user such that the corresponding link arm 70 is caused to temporarily pivot to a position (refer to FIG. 16A) in which the link arm 70 is slightly further rotated in the clockwise direction than when the leg 60A is in the vertically standing state. Specifically, the link arm 70 is pivoted to an engagement position where the engagement hole 71 of the link arm 70 is once in engagement with the protruding portion 73, and then further pivoted to a pivotal position beyond the engagement position and lower than the engagement position. This pivoting operation is intended to cause the hook portion 65 of the upper end portion 60*b* of the leg 60A to be positioned at a height position at which the hook portion 65 is permitted to pass through the engagement hole 66*b* of the fitment 66 (refer to FIG. 17A). The pivoting operation is carried out before or after the upper end portion 60*b* of the leg 60A is moved close to the main board 10.

Next, in this state, the hook portion 65 is caused to be inserted into the engagement hole 66*b*, and then the entire leg 60A is moved upward to thereby bring the engagement recess 63 in engagement with the engagement portion 66*a* of the fitment 66. At this time, the link arm 70 is slightly moved in the counterclockwise direction. When the engagement recess 63 is in engagement with the engagement portion 66*a*, the protruding portion 73 and the engagement hole 71 are fitted to each other (refer to FIG. 14). This operation is carried out for all the legs 60. For ease of operation, a desired one pair of legs (for example, the legs 60A and 60C) are first brought into the vertically standing state.

When the lower end portions 60 of the pair of the legs 60 vertically arranged are brought in contact with the ground, the lower end of the engagement portion 66*a* is made contact with the bottom surface 63*a* of the engagement recess 63, and therefore, the weight of the main board 10 is applied to the bottom surface 63*a*. With a resultant force, the upper end portion 60*b* of the leg 60A attempts to rotate in the direction toward the main board 10. However, the contact surface 64 is in contact with the counterpart surface of the fitment 66, whereby a pivotal motion of the leg 60A is restricted (refer to FIGS. 14 and 17A).

Specifically, the bottom faces 63*a* of the legs 60A, 60C receive the weight of the main board 10, whereas the contact surfaces 64 of these legs are in contact with and hold the corresponding fitments 66. Since forces received at opposite contact surfaces 64 are balanced, the main board 10 is never applied with a force such as an excessive bending moment by which a deformation is caused. As a result, the main board 10 is stably held in parallel to the vertical direction. An upper end of the hook portion 65 is at a location above a lower end of the engagement portion 66*a*. Therefore, even if the upper end portion 60*b* of the leg 60A is pulled toward the player side, the hook portion 65 is caught by the engagement portion 66*a*, and the engagement between the engagement portion 66*a* and the engagement recess 63 is not easily released. Thus, the hook portion 65 achieves a function of simply maintaining the engagement.

To fold the leg 60A for storage of the instrument, the steps of realizing the vertical configuration are reversed. Specifically, the lower end portion 60*a* is made slightly floating from the floor, and the entire leg 60A is moved downward. Then, the engagement between the engagement portion 66*a* and the engagement recess 63 is released (refer to FIG. 16A), and the hook portion 65 is pulled out from the engagement hole 66*b*. Subsequently, the leg 60A is pivoted in the clockwise direction so as to be moved to a position in which it is made parallel to the main board 10 (refer to FIG. 16B). The protruding portion 73 is made fitted into the engagement hole 62 of the leg 60A, whereupon folding the leg 60A is completed.

When the percussion instrument is in the folded state, as shown in FIG. 6, all the drum boards 20A to 20G and the operation panel unit 19 are positioned inside the outer periphery 11 of the main board 10 as seen from front. Besides, all the legs 60 are also positioned inside the outer periphery 11 when they are folded. As a result, at the time of storage, the entire percussion instrument can be made compact in the surface direction of the main board 10 (in the direction parallel to the player-side surface 10*a* of the main board 10). Thus, as viewed from front, the entire percussion instrument can be made compact.

Figure 17B:
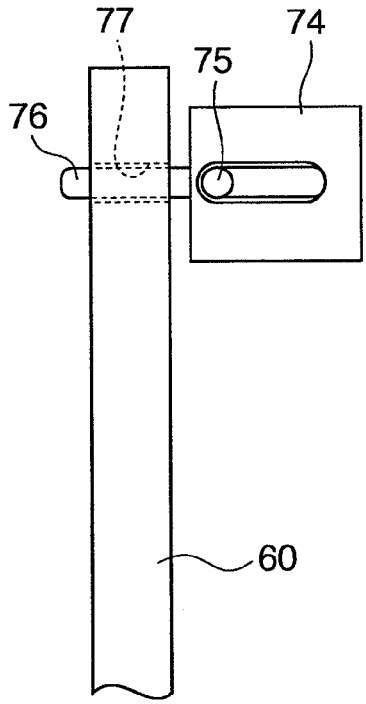
FIG. 17B is a front view showing the modification of the engagement between the upper end portion of the leg and the counterpart fitment.

FIGS. 17A and 17B are a section view and a front view showing a modification of the engagement part between an upper end portion 60*b* of the leg 60*a* and a counterpart fitment 66. As described above, the hook portion 65 offers a simple engagement maintaining function. In the modification shown in FIGS. 17A and 17B, there is provided a lock mechanism for ensuring the engagement between the engagement portion 66*a* and the engagement recess 63.

First, a block 74 is fixed to a player-side surface of a counterpart fitment 66 at a location next to the right side of the upper end portion 60*b* of the leg 60A. A pin 76 is provided in the block 74 for sliding motion in the left-to-right direction. The pin 76 is provided with a knob 75 and configured to be subjected to a slide operation. On the other hand, a hole 77 into which the pin 76 is inserted and from which the pin is pulled out is formed in the upper end portion 60*b* of the leg 60A in the left-to-right direction.

In this construction, the pin 76 is slid toward the left with the knob 75 being grasped in a condition that the engagement portion 66*a* and the engagement recess 63 are engaged with each other, and the pin 76 is inserted into the hole 77. As a result, the engagement between the engagement portion 66*a* and the engagement recess 63 is locked. Even if the main board 10 is held and lifted upward, the upper end portion 60*b* of the leg 60A is prevented from moving away from the counterpart fitment 66. Thus, the entire percussion instrument can be easily moved, with the main board 10 grasped.

According to the present embodiment, the drum board 20 can be unfolded from and folded to the main board 10. The instrument in the unfolded state is suitable for musical performance, whereas the folded percussion instrument can easily be stored in a compact manner. In particular, the drum board 20 is made closer to the main board 10 and much parallel to the main board 10 when it is in the folded configuration than when it is in the unfolded configuration. Thus, at the time of storage, the instrument can be made compact in the thickness direction of the main board 10.

In the folded configuration, the drum board 20G is in a fixed position in which it is superimposed on the main board 10 and stacked with the drum board 20A. The drum board 20G is made closer to the drum board 20A than when it is in the unfolded configuration, and both the drum boards 20A, 20G are made close and parallel to the main board 10 (refer to FIGS. 6-8). Thus, even the percussion instrument having the drum board 20G corresponding to a hi-hat cymbal can compactly be stored.

The drum boards 20*c* to 20F are mounted through the pivoting neck portions 23C, 23D, 24E and 24F to the free ends of the corresponding arms 25 with a variable angle (refer to FIGS. 2, 4 and 7). This increases the degree of freedom of folding forms. As a result, the drum boards 20C to 20F can be made parallel to the main board 10 in the folded configuration, while realizing an angular adjustment of the drum board 20C to 20F in the unfolded configuration (at the time of musical performance).

The drum board 20G is configured to be variable in angle and position by being coupled to the arm 25A through the link mechanism comprised of the coupling arm 25G1, the first pivoting mechanism unit 21G1, the arm 25G2, and the first pivoting mechanism unit 21G2 (refer to FIG. 10). As a result, the configuration of the drum board 20G can be changed between a state where it is made close to and stacked on the drum board 20A and another state where it is spaced from and made parallel to the drum board 20A. As compared to an arrangement of directly coupling the arms 25G1, 25G2 to the main board 10, the arm 25G2 can be made small, thus contributing to compacting the percussion instrument. Furthermore, when the drum boards 20A, 20G are stacked on the main board 10, the arm 25G2 is in a stacking relation with the drum boards 20A, 20G by being interposed therebetween (refer to FIG. 8). Thus, the arm 25G2 is not bulky, and contributes to making the percussion instrument compact.

In the folded state, all of the drum boards 20, the legs 60, and the operation panel unit 19 are positioned inside the outer periphery of the main board 10 as seen from front. As a result, the entire percussion instrument can be made compact in the surface direction of the main board 10 for storage of the instrument.

The displacement strokes observed when the drum boards 20A to 20G and the operation panel unit 19 are unfolded/folded do not interfere with one another.

This makes it possible for the drum boards 20 and the operation panel unit 19 to be appropriately displaced independently of one another, without the need of considering the order in which they are unfolded/folded, whereby they can always appropriately be unfolded/folded.

From the viewpoint of enabling the drum boards 20 to be folded on the main board 10 for easy and compact storage, it is most preferable that the drum boards 20 be made close to and parallel to the main board 10 as in the just-mentioned construction. However, this is not limitative. In almost types of instruments, from the viewpoint of easily realizing a compact structure, it enough to configure the percussion instrument such that the total sum of minimum distances between the main board 10 and all the positions on the outer periphery of the drum board 20 is made smaller when the instrument is in the folded configuration than when it is in the unfolded configuration (refer to FIGS. 13A through 13C).

According to this embodiment, inside the frame portion 13 that recalls a bass drum, the bass drum board 12 is fixedly provided in the player-side surface 10*a* of the main board 10, and the speaker 17 is disposed avoiding the bass drum board 12 within the frame portion 13 as viewed from front (refer to FIG. 3). This ensures that the speaker 17 is protected from affection of the bass drum board 12 being struck, and wiring extending outside the speaker 17 is eliminated thereby simplifying wiring connection. Sounds are generated from near the bass drum board 12, and the sounding section of the speaker 17 is directed to the player. This increases the reality of sound generation. Furthermore, since the circuit board 18 is provided in the casing 15, it is possible to shorten the wiring between the speaker 17 and the board 18.

According to the present embodiment, the drum boards 20E, 20F are mounted through the arms 25E, 25F to the second pivoting mechanism units 22E, 22F for pivotal motion, and each of the second pivoting mechanism units 22E, 22F includes therein the speaker 50 for generating a musical tone in response to the drum board 20E or 20F being struck (refer to FIG. 12). Thus, a musical tone corresponding to the struck drum board 20E or 20F can be generated from the prescribed speaker 50 disposed near the striking position, whereby the reality can be increased. Furthermore, the musical tone generating mechanisms are housed in the second pivoting mechanism unit 22E, 22F which are pivoting mechanisms, resulting in a compact structure.

According to the present embodiment, the main board 10 is brought into a vertically standing state by engaging the engagement portions 66*a* of the legs 60 with the counterpart fitments 66 and by bringing the lower end portions 60*a* of the legs 60 in contact with the ground. On the other hand, the legs 60 and the link arms 70 are made into the folded state by releasing the engagement between the engagement portions 66*a* and the engagement recesses 63 and by making the legs 60 close to and parallel to the main board 10 (refer to FIGS. 14 to 16B). Thus, with simple operations, the main board 10 which is of a thin type can be brought into and held in the vertically standing state. In addition, the instrument at the time of storage can be prevented from being bulky.

In the vertically standing state, the protruding portions 73 provided in the projecting stays 67 are fitted into respective ones of the engagement holes 71 of the link arms 70. In the folded state of the legs 60, on the other hand, the protruding portions 73 are fitted into the engagement holes 62 of the legs 60 (refer to FIGS. 15 and 16B). This makes it possible to stabilize both the vertically standing state of the main board 10 and the folded state of the legs 60 and the link arms 70. The construction of engagement is not limited to using the protruding portions 73 and the engagement holes 71, 62 since it is enough for the engagement such as fitting engagement to apply a small restriction force to pivotal motions of the link arms 70. For example, locations at which the protruding portions 73 and the holes 71, 62 are formed may be reversed.

Each of the engagement recesses 63 has its bottom surface 63*a* receiving the weight of the main board 10 and its contact surface 64 urging the upper end portion 60*b* of the leg 60 toward the main board 10. Thus, the main board 10 can be stably held with a simple structure.

The legs 60, the link arms 70, the engagement portions 66*a*, and the engagement recesses 63 are provided in two pairs so as to be spaced from and symmetrical to each other on the player side and the audience side of the main board 10, with the main board 10 interposed between them. In the vertically standing state, the main board 10 is in a floating state in which the lower end edge thereof is perfectly spaced from the floor.

As far as from the viewpoint of vertically arranging the main board 10, there is only required to provide one pair of the legs 60 and the like. For example, only one pair of the legs 60 and the like are provided in left and right end portions of the main board 10, and a protruding portion for being contact with the ground is provided at a lower edge of the main board 10 at a location away from the legs and the like. By making the protruding portion in direct contact with the ground, the percussion instrument may be vertically arranged with three point support. To this end, it is enough to configure the percussion instrument such that an upper edge of the main board 10 is made parallel to the left-to-right direction when the instrument is vertically arranged. Even in that case, when the main board 10 is in the vertically standing state, at least that part of a lower edge of the main board 10 in which the legs 60 and the like are mounted is made floating from the floor.

In the present embodiment, one or more drum boards other than the bass drum board 12 may be fixedly provided in the main board 10.

As far as the drum board 20 is made foldable to the main board 10 for easy and compact storage of the percussion instrument, the instrument may not be an electronic drum but may be an acoustic percussion instrument or a percussion instrument having drum boards 20 each comprised of a practice pad.

The main board 10 is preferably formed into a plate shape as in the foregoing embodiment as far as from the viewpoint of stably holding the drum board 20, but this is not limitative as far as for easy and compact storage of the percussion instrument. For example, the main board may be formed into a curved shape or may be a net.

Figure 18:
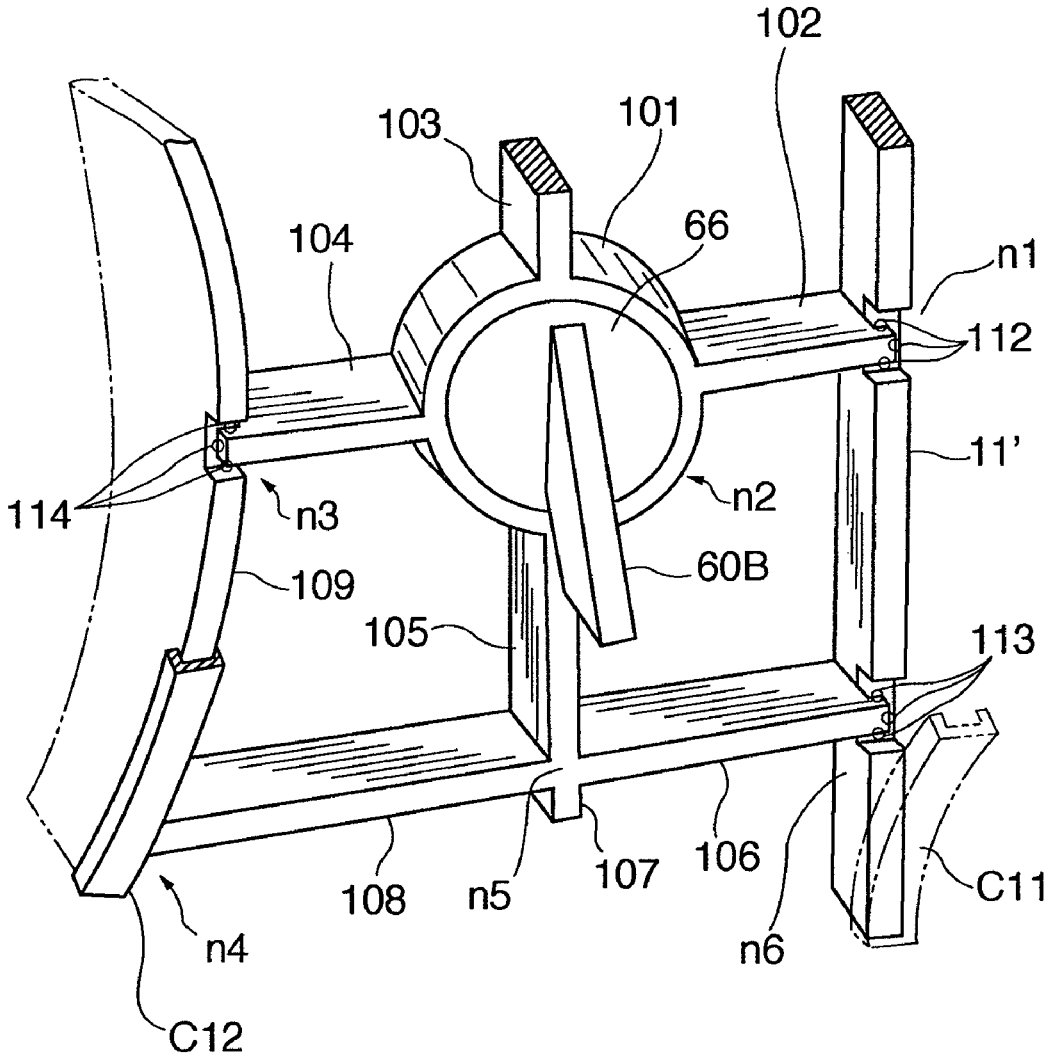
FIG. 18 is a fragmentary perspective view showing a main board of a percussion instrument according to a modification of the embodiment of the present invention.

FIG. 18 is a fragmentary perspective view showing a main board of a percussion instrument according to a modification of the aforementioned embodiment. The percussion instrument of the embodiment comprises the solid plate-like main board 10 to which are fixed the bass drum board, the frame 13, the speakers 17, the first pivoting mechanism units 21A, 21B, the arms 25, the sounding section 50*a*, the fitments, and the like. On the other hand, the percussion instrument according to this modification comprises a main board formed into a net-like construction.

As shown in FIG. 18, the net-like main board of this modification comprises an outermost frame 11' formed into an elongated rectangular shape, for instance, as seen from front, and a plurality of net members arranged in a grid inside the outermost frame 11'. The outer frame 11' is connected to some of the net members at intersections, and other net members are connected to one another at their intersections.

As in the embodiment, the net-like main board is configured to be fixedly mounted with the just-mentioned components 12, 13, 17, 21A, 21B, 25, 50*a*, 66 and the like. In this modification, the mounting of these components to the net-like main board is performed by fixing each component to a corresponding one of the intersections between the frame 11' and some of the net members and between other net members.

In FIG. 18, there is shown a fitment 66 which is one of the components mounted to the net-like main board. A circular annular node n2 used for mounting the fitment 66 to the main board is formed at an intersection between four arms or stays (hereinafter referred to as the arms) 102 to 105, which are net members. The circular annular node n2 comprises an annular body 101 to which the arms 102 to 105 are connected, and the fitment 66 is fittedly fixed to the annular body 101. As in the embodiment, a leg 60B is mounted to the net-like main body via the fitment 66. Although an illustration is omitted, other components 12, 13, 17, 21A, 21B, 25, 50*a* and the like are also mounted to the net-like main board in the same manner as the fitment 66 in the same arrangement as the component arrangement shown in FIG. 1.

Out of intersections between net members, a simple node construction is formed at each of intersections to which no component is mounted. In the simple node construction, net members are simply connected to one another. In FIG. 18, symbol n4 shows an example of the simple node construction. In this simple node construction n4, arms 105 to 108 are connected to one another in a cross shape.

Symbol n1 shows a node formed at an intersection between an outermost frame 11' and an arm 102. In the node n1, the frame 11' and the arm 102 are spot-welded or arc-welded at three points 112 on the player side and at three points (not shown) on the audience side, so that they are fixedly connected. Symbol n6 denotes a node formed at an intersection between the frame 11' and an arm 106. The frame 11' and the arm 106 are fixedly connected to each other in the node n6, as in the case of the node n1. Reference numeral 113 denotes three welding points on the player side.

Symbol C11 denotes part of a cover member mounted to a player-side surface of the outermost frame 11'. By mounting the cover member C11 to the frame 11', connection portions between the frame 11' and various arms such as the arms 102, 106 are covered, whereby the connection portions are concealed to thereby improve the external appearance of the main body. The arms such as the arms 102, 106 have their player-side surfaces which are made lower than the player-side surface of the frame 11', to thereby allow slight deformation of the frame 11' and the arm at the welding, whereby the cover member C11 can be mounted on the frame 11'.

Symbol n3 denotes a node formed at an intersection between a frame 109 for bass drum and an arm 104. In the node n3, the frame 109 and the arm 104 are fixedly connected. Reference numeral 114 denotes three welding points on the player side. Symbol n4 denotes a node formed at an intersection between the frame 109 and an arm 108, and the node n4 is covered by a cover member C12 (part of which is shown in FIG. 18). When the cover member C12 is mounted to the player-side surface of the frame 109 for bas drum, connection portions between the frame 109 and arms such as the arms 104, 108 are covered, whereby the external appearance of the main body is improved. In order to permit the cover member C12 to be mounted on the frame 109, player-side surfaces of the arms are made lower than the player-side surface of the frame 109.

A mechanism may be provided to restrict a pivotal range of the drum boards 20 and the operation panel unit 19 so that the positions of the unfolded and folded configurations are made constant. Such a mechanism may be provided in the first pivoting mechanism unit 21 and/or the second pivoting mechanism unit 22. Contact members adapted to be in contact with the drum boards 20 and the like may be fixed in the drum boards and the like. In this case, any one can unfold/fold the drum boards 20 and the like always at the same positions, thereby reproducing the same unfolded/folded state.

In order to realize a structure capable of stacking the drum board 20G on the drum board 20A, the drum boards 20A, 20G may be configured such as to be displaceable via any other arm members than the arms 25*a*, 25G1 and 25G2. The construction for causing the drum board 20G to be displaced is not limited to the construction for being pivoted via the arm members (arms 25G1 and 25G2) attached to the arm 25A. For example, as in the drum board 20A, the drum board 20G may be configured for being pivoted relative to the main board 10 via an arm member, and for being stacked on the drum board 20A in the folded state.

What is claimed is:

1. A percussion instrument, comprising:

a main board formed into a plate-like shape and having a surface;

a drum board configured to be unfoldable from and foldable to said main board; and a drum board supporting link member pivotably mounted to said main board at a proximal end thereof and having a free end to which said drum board is pivotably mounted, wherein said drum board is configured to be unfoldable from main board in such a manner that an extended surface thereof crosses with the surface of the main board vertically arranged at the time of a musical performance, and said drum board and said link member are configured to be foldable to said main board at the time of storage in default of a musical performance, wherein said link member comprises a plurality of support members, each of which has a free end and a proximal end, and each support member is mounted at the proximal end to a part fixed relative to said main board such that the free end is displaceable in position; and said drum board comprises a plurality, of drum boards, each of which is mounted at the free end to a corresponding one of said support members, and each drum board of said plurality of drum boards is changeable between an unfolded configuration suitable for a musical performance and a folded configuration suitable for storage by being configured to be unfoldable from and foldable to said main board via said support member, wherein each of said drum boards is disposed closer to said main board when it is in the folded configuration than when it is in the unfolded configuration, and wherein said drum boards are configured to be foldable to said main board at the time of both the unfolded configuration and the folded configuration.

2. The percussion instrument according to claim 1, wherein at least one surface of each of said drum boards are arranged in parallel with the surface of said main board when said drum boards are folded to said main board.

3. The percussion instrument according to claim 2, wherein both surfaces of each of said drum boards are arranged in parallel with the surface of said main board when said drum boards are folded to said main board.

4. The percussion instrument according to claim 1, wherein each of said drum boards is more parallel to said main board when it is in the folded configuration than when in the unfolded configuration.

5. The percussion instrument according to claim 1, wherein each of said drum boards has its outer periphery, and a sum of minimum distances between said main board and all positions on the outer periphery is smaller when it is in the folded configuration than when it is in the unfolded configuration.

6. The percussion instrument according to claim 1, wherein said main board has its outer periphery, and all said drum boards are disposed within the outer periphery of said main board as viewed from front of said main board when said drum boards are in the folded configuration.

7. The percussion instrument according to claim 1, wherein a displacement stroke of each of said drum boards between the unfolded configuration and the folded configuration is arranged so as not to interfere with the displacement stroke of another drum board.

8. The percussion instrument according to claim 1, wherein said main board has a player-side surface thereof adapted to face a player when said main board is vertically arranged for musical performance, a circular or polygonal framed is provided in the player-side surface of said main board and formed into a drum shell shaped as viewed from the player, a percussion unit is provided in the player-side surface of said main board in a region within said frame of said main board; and a sound generation unit is disposed within the frame of said main board avoiding a location where said percussion unit is disposed, as viewed from the player.

9. The percussion instrument according to claim 8, wherein a plurality of said sound generation units each provided with a sounding section are provided, said each sound generation unit is disposed such that the sounding section thereof is directed toward the player.

10. The percussion instrument according to claim 1, wherein said main board has a player-side surface thereof adapted to face a player when said main board is vertically arranged for musical performance, and said percussion instrument further comprises a casing provided in said main board and formed into a drum shape, a percussion unit provided in the player-side surface of said main board on a player side of said casing, and a board disposed within said casing.

11. The percussion instrument according to claim 10, further including:

a sound generation unit disposed within said casing avoiding a location where said percussion unit is disposed, as viewed from the player.

12. The percussion instrument according to claim 1, wherein said link member comprises at least one support member having a free end and a proximal end thereof, said support member being mounted at the proximal end to said main board such that the free end of said support member is displaceable in position, said drum board comprises at least one drum board mounted to the free end of said support member, and said percussion instrument further comprises a sound generator unit disposed in said main board on a player side of the proximal end of said support member and configured to generate a musical tone in response to said drum board being struck.

13. The electronic percussion instrument according to claim 12, wherein said main board has a player-side surface adapted to face a player when said main board is vertically arranged for a musical performance, said support member is configured so as to be pivotable around the proximal end in a direction in which the player-side surface of said main board extends, and when said support member rotates around the proximal end, said drum board is changeable between an unfolded configuration suitable for a musical performance in which said drum board is moved away from said main board and a folded configuration suitable for storage in which said drum board is disposed close to and facing said main board.

14. The electronic percussion instrument according to claim 12, a plurality of said support members, a plurality of said drum boards, and a plurality of said sound generator units are provided so as to correspond to one another, each of said plurality of said sound generator units is disposed in said main board on a player side of the proximal end of a corresponding one of said support members and configured to generate a musical tone in response to a corresponding one of said drum boards being struck.

15. A percussion instrument, comprising:

a main board formed into a plate-like shape and having a surface;

a drum board configured to be unfoldable from and foldable to said main board; and a drum board supporting link member pivotably mounted to said main board at a proximal end thereof and having a free end to which said drum board is pivotably mounted, wherein said drum board is configured to be unfoldable from main board in such a manner that an extended surface thereof crosses with the surface of the main board vertically arranged at the time of a musical performance, and said drum board and said link member are configured to be foldable to said main board at the time of storage in default of a musical performance, wherein said link member comprises a first support member and a second support member, said drum board comprises a first drum board supported by said main board via at least said first support member so as to be movable relative to said main board, and a second drum board supported by said main board via at least said second support member so as to be movable relative to said main board, wherein said first and second drum boards are configured to be changeable, via said first and second support members, between an unfolded configuration suitable for a musical performance and a folded configuration suitable for storage, and wherein when said first and second drum boards are in the folded configuration, they are stacked to each other at a fixed position and disposed closer to each other than when they are in the unfolded configuration.

16. The percussion instrument according to claim 15, wherein said second support member has a free end and a proximal end and is mounted at the proximal end to said first support member such that the free end thereof is displaceable in position, and wherein said second drum board is mounted at the free end to said second support member so as to be variable in angle relative to the free end of said second support member.

17. The percussion instrument according to claim 15, wherein said main board has held thereon a plurality of drum boards other than said first and second drum boards.

18. The percussion instrument according to claim 17, wherein said first and second drum boards are more parallel to said main board when they are in the folded configuration than when in the unfolded configuration.

19. The percussion instrument according to claim 17, wherein said main board has an outer periphery, and both the first and second drum boards are disposed within the outer periphery of said main board as viewed from front of said main board when they are in the folded configuration.

20. A percussion instrument, comprising:

a main board formed into a plate-like shape and having a surface;

a drum board configured to be unfoldable from and foldable to said main board; and a drum board supporting link member pivotably mounted to said main board at a proximal end thereof and having a free end to which said drum board is pivotably mounted, wherein said drum board is configured to be unfoldable from main board in such a manner that an extended surface thereof crosses with the surface of the main board vertically arranged at the time of a musical performance, and said drum board and said link member are configured to be foldable to said main board at the time of storage in default of a musical performance, wherein said link member comprises a first stay and a second stay, said drum board comprises a first drum board supported by said main board via at least said first stay so as to be movable relative to said main board, and a second drum board supported by said main board via at least said second stay so as to be movable relative to said main board, wherein said first and second drum boards are configured to be variable in configuration, via said first and second stays, respectively, between an unfolded configuration suitable for a musical performance and a folded configuration suitable for storage, and wherein when said first and second drum boards are in the folded configuration, they are stacked to each other at a fixed position and disposed closer to each other than in the unfolded configuration.

* * * * *